US006516734B1

(12) United States Patent
Morgante et al.

(10) Patent No.: US 6,516,734 B1
(45) Date of Patent: Feb. 11, 2003

(54) INDEPENDENT SERVO MOTOR CONTROLLED SCROLL-TYPE PATTERN ATTACHMENT FOR TUFTING MACHINE AND COMPUTERIZED DESIGN SYSTEM

(75) Inventors: Michael R. Morgante, East Aurera, NY (US); Mike Bishop, Signal Mountain, TN (US); Randall E. Stanfield, Soddy-Daisy, TN (US); Eric J. Vaughen, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 09/878,653

(22) Filed: Jun. 11, 2001

Related U.S. Application Data

(63) Continuation of application No. 08/980,045, filed on Nov. 26, 1997, now Pat. No. 6,224,203

(60) Provisional application No. 60/031,954, filed on Nov. 27,

(51) Int. Cl.[7] ..... D05C 15/18

(52) U.S. Cl. ..... 112/80.73

(58) Field of Search ..... 112/80.73, 80.23, 112/80.41, 80.01, 475.23, 220; 242/364, 366.4

(56) References Cited

U.S. PATENT DOCUMENTS 6,213,036 B1 * 4/2001 Slattery ..... 112/80.73
6,244,203 B1 * 6/2001 Morgante et al. ..... 112/475.23
6,283,053 B1 * 9/2001 Morgante et al. ..... 112/80.73

* cited by examiner

*Primary Examiner*—Peter Nerbun
(74) *Attorney, Agent, or Firm*—Douglas T. Johnson

(57) ABSTRACT

The present invention provides a scroll-type yarn feed attachment for tufting machines characterized by independent servo-motor control of yarn feed rolls.

9 Claims, 40 Drawing Sheets

Circle.3PH
Date: 10/30/96 Time: 13:58
Pattern Width: 16 Pattern Length: 16 Block Width: 2 Block Length: 2

95 High Pile Height

Midium Pile Height

90 Low Pile Height

Pattern Statistics for Rear Pattern Attachment

Pattern last loaded: F:\tdswin\circle.3PH
Print date and time: 10/29/96 (06:53:10am)

Pattern Width: 16
Step Length: 16

Speed Usage

| Speed | Count | Speed# |
|---|---|---|
| 0.825 | 144 | 1 |
| 0.311 | 56 | 2 |
| 0.545 | 56 | 3 |

Available Speeds: 253

| # of Speeds | # of Steps Using |
|---|---|
| 1 | 2 |
| 2 | 2 |
| 3 | 12 |

Stepping Relationships

Needle # ----->

| -7 | -6 | -5 | -4 | -3 | -2 | -1 | 0 | 1 | 2 | 3 | 4 | 5 | 6 | 7 | Stp# | 1 | 2 | 3 | 4 | 5 | 6 | 7...120 |
|---|---|---|---|---|---|---|---|---|---|---|---|---|---|---|---|---|---|---|---|---|---|---|
| | | | | | | | R | | | | | | | | 1 | S1 | S1 | S1 | S1 | S1 | S1 | S1 |
| | | | | | | | R | | | | | | | | 2 | S1 | S1 | S1 | S1 | S1 | S2 | S2 |
| | | | | | | | R | | | | | | | | 3 | S1 | S1 | S1 | S2 | S2 | S2 | S3 |
| | | | | | | | R | | | | | | | | 4 | S1 | S1 | S2 | S2 | S3 | S3 | S3 |
| | | | | | | | R | | | | | | | | 5 | S1 | S1 | S2 | S3 | S3 | S1 | S1 |
| | | | | | | | R | | | | | | | | 6 | S1 | S2 | S2 | S3 | S1 | S1 | S1 |
| | | | | | | | R | | | | | | | | 7 | S1 | S2 | S3 | S3 | S1 | S1 | S3 |
| | | | | | | | R | | | | | | | | 8 | S1 | S2 | S3 | S1 | S1 | S1 | S3 |
| | | | | | | | R | | | | | | | | 9 | S1 | S2 | S3 | S1 | S1 | S1 | S3 |
| | | | | | | | R | | | | | | | | 10 | S1 | S2 | S3 | S3 | S1 | S1 | S3 |
| | | | | | | | R | | | | | | | | 11 | S1 | S2 | S2 | S3 | S1 | S1 | S1 |
| | | | | | | | R | | | | | | | | 12 | S1 | S1 | S2 | S3 | S3 | S1 | S1 |
| | | | | | | | R | | | | | | | | 13 | S1 | S1 | S2 | S2 | S3 | S3 | S3 |
| | | | | | | | R | | | | | | | | 14 | S1 | S1 | S1 | S2 | S2 | S2 | S3 |
| | | | | | | | R | | | | | | | | 15 | S1 | S1 | S1 | S1 | S1 | S2 | S2 |
| | | | | | | | R | | | | | | | | 16 | S1 | S1 | S1 | S1 | S1 | S1 | S1 |

S1 ⟶ S2 = HIGH TO LOW TRANSITION
S2 ⟶ S1 = LOW TO HIGH TRANSITION

FIG 9

*Pattern Statistics for Rear Pattern Attachment*
*Pattern last loaded: F:\tdswin\circle.3PH*
*Print date and time: 10/29/96 (06:53:10am)*
*Pattern Width: 16*
*Step Length: 16*

*Speed Usage*

| Speed | Count | Speed# |
|---|---|---|
| 0.825 | 116 | 1 |
| 0.311 | 28 | 2 |
| 0.545 | 28 | 3 |
| 0.002 | 28 | 4 |
| 1.000 | 14 | 5 |
| 0.600 | 14 | 6 |
| 0.900 | 14 | 7 |
| 0.400 | 14 | 8 |

*Available Speeds: 248*

| # of Speeds | # of Steps Using |
|---|---|
| 1 | 1 |
| 2 | 2 |
| 3 | 1 |
| 4 | 2 |
| 5 | 8 |
| 6 | 2 |

*Stepping Relationships*

Needle # ----->

| -7 | -6 | -5 | -4 | -3 | -2 | -1 | 0 | 1 | 2 | 3 | 4 | 5 | 6 | 7 | Stp# | 1 | 2 | 3 | 4 | 5 | 6 | 7...120 |
|---|---|---|---|---|---|---|---|---|---|---|---|---|---|---|---|---|---|---|---|---|---|---|
| | | | | | | | R | | | | | | | | 1 | S1 | S1 | S1 | S1 | S1 | S1 | S1 |
| | | | | | | | R | | | | | | | | 2 | S1 | S1 | S1 | S1 | S1 | S4 | S4 |
| | | | | | | | R | | | | | | | | 3 | S1 | S1 | S1 | S4 | S4 | S2 | S6 |
| | | | | | | | R | | | | | | | | 4 | S1 | S1 | S4 | S2 | S6 | S6 | S3 |
| | | | | | | | R | | | | | | | | 5 | S1 | $\boxed{S1}$ | S2 | S6 | S3 | S7 | S7 |
| | | | | | | | R | | | | | | | | 6 | S1 | $\boxed{S4}$ | S2 | S3 | S7 | S1 | S1 |
| | | | | | | | R | | | | | | | | 7 | S1 | $\boxed{S2}$ | S6 | S3 | S1 | S1 | S8 |
| | | | | | | | R | | | | | | | | 8 | S1 | S2 | S3 | S7 | S1 | S1 | S3 |
| | | | | | | | R | | | | | | | | 9 | S1 | S2 | S3 | S1 | S1 | S1 | S3 |
| | | | | | | | R | | | | | | | | 10 | S1 | S2 | S3 | S8 | S1 | S1 | S3 |
| | | | | | | | R | | | | | | | | 11 | S1 | $\boxed{S2}$ | S4 | S3 | S1 | S1 | S7 |
| | | | | | | | R | | | | | | | | 12 | S1 | $\boxed{S5}$ | S2 | S3 | S8 | S1 | S1 |
| | | | | | | | R | | | | | | | | 13 | S1 | $\boxed{S1}$ | S2 | S4 | S3 | S8 | S8 |
| | | | | | | | R | | | | | | | | 14 | S1 | S1 | S5 | S2 | S4 | S4 | S3 |
| | | | | | | | R | | | | | | | | 15 | S1 | S1 | S1 | S5 | S5 | S2 | S4 |
| | | | | | | | R | | | | | | | | 16 | S1 | S1 | S1 | S1 | S1 | S5 | S5 |

S1 → S4 → S2
(0.825) → (0.002) → (0.311) ] HIGH TO LOW TRANSITION

S2 → S5 → S1
(0.311) → (1.000) → (0.825) ] LOW TO HIGH TRANSITION

FIG 10

INDEPENDENT SERVO MOTOR CONTROLLED SCROLL-TYPE PATTERN ATTACHMENT FOR TUFTING MACHINE AND COMPUTERIZED DESIGN SYSTEM

This application is a continuation of U.S. patent application Ser. No. 08/980,045, filed Nov. 26, 1997 now U.S. Pat. No. 6,224,203, which claims priority of provisional appl. No. 60/031,954, filed Nov. 27, 1996, and is incorporated in its entirety.

BACKGROUND OF THE INVENTION

This invention relates to a yarn feed mechanism for a tufting machine and more particularly. to a scroll-type pattern controlled yarn feed wherein each set of yarn feed rolls is driven by an independently controlled servo motor. A computerized design system is also provided because of the complexities of working with the large numbers of individually controllable design parameters available to the new yarn feed mechanism.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. There are many limitations on roll-type pattern devices. Perhaps the most significant limitations are: (1) as a practical matter, there is not room on a tufting machine for more than about eight pairs of yarn feed rolls; (2) the yarn feed rolls can be driven at only one of two, or possibly three used—a wider selection of speeds is possible when using direct servo motor control, but powerful motors and high gear rotors are required and the shear mass involved makes quick stitch by stitch adjustments difficult; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 addresses this last problem.

The pattern control yarn feed rolls referred to as scroll-type pattern attachments are disclosed in J. L. Card, U.S. Pat. No. 2,862,465, are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle. In this fashion yarn feed rolls need not extend transversely across the entire width of the tufting machine and it is physically possible to mount many more yarn feed rolls across the machine. Typically, scroll pattern attachments have between 36 and 120 sets of rolls, and by use of electrically operated clutches each set of rolls can select from two, or possibly three, different speeds for each stitch.

The use of yarn feed tubes introduces additional complexity and expense in the manufacture of the tufting machine; however, the greater problem is posed by the differing distances that yarns must travel through yarn feed tubes to their respective needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn. The most significant limitation of scroll-type pattern attachments, however, is that each pair of yarn feed rolls is mounted on the same set of drive shafts so that for each stitch, yarns can only be driven at a speed corresponding to one of those shafts depending upon which electromagnetic clutch is activated. Accordingly, it has not proven possible to provide more than two, or possibly three, stitch heights for any given stitch of a needle bar.

As the use of servo motors to power yarn feed pattern devices has evolved, it has become well known that it is desirable to use many different stitch lengths in a single pattern. Prior to the use of servo motors, yarn feed pattern devices were powered by chains or other mechanical linkage with the main drive shaft and only two or three stitch heights, in predetermined ratios to the revolutions of the main drive shaft, could be utilized in an entire pattern. With the advent of servo motors, the drive shafts of yarn feed pattern devices could be driven at almost any selected speed for a particular stitch.

Thus a servo motor driven pattern device might run a high speed drive shaft to feed yarn at 0.9 inches per stitch if the needle bar does not shift, 1.0 inches if the needle bar shifts one gauge unit, and 1.1 inches if the needle bar shifts two gauge units. Other slight variations in yarn feed amounts are also desirable, for instance, when a yarn has been sewing low stitches and it is next to sew a high stitch, the yarn needs to be slightly overfed so that the high stitch will reach the full height of subsequent high stitches. Similarly, when a yarn has been sewing high stitches and it is next to sew a low stitch, the yarn needs to be slightly underfed so that the low stitch will be as low as the subsequent low stitches. In addition, some yarn feed rolls, particularly at the ends of the tufting machine, may experience relatively more yarn drag from the tube bank. Compensation for this additional drag can be provided by very slightly overfeeding the yarn on those rolls. Therefore, there is a need to provide a pattern control yarn feed device capable of producing scroll-type patterns and of feeding the yarns from each pair of yarn feed rolls at an individualized rate.

SUMMARY OF THE INVENTION

It is therefore an object of this invention to provide in a multiple needle tufting machine a pattern controlled yarn feed mechanism incorporating a plurality of individually driven sets of yarn feed rolls across the tufting machine.

The yarn feed mechanism made in accordance with this invention includes a plurality of sets of yarn feed rolls, each set being in direct communication with a servo motor. Two sets of yarn feed rolls, and two servo motors, are mounted upon a plurality of transversely spaced supports on the machine. Each set of yarn feed rolls is driven at the speed dictated by its corresponding servo motor and each servo motor can be individually controlled.

It is a further object of this invention to provide a pattern controlled yarn feed mechanism which does not rely upon electromagnetic clutches, but instead uses only servo motors.

It is another object of this invention to provide an improved tube bank to further minimize the differences in yarn feed rates to individual needles.

It is yet another object of this invention to provide a computerized design system to create, modify, and graphically display complex carpet patterns suitable for use upon a pattern controlled yarn feed mechanism in which each set of yarn feed rolls is independently controlled and may rotate at any of numerous possible speeds on each stitch of a pattern.

BRIEF DESCRIPTION OF THE DRAWINGS

FIG. 9 is a chart of the needle stepping relationships for the pattern of FIG. 8 according to a conventional scroll attachment using only three yarn feed speeds.

FIG. 10 is a chart of the needle stepping relationships and yarn feed speeds utilized for the pattern of FIG. 8 in a tufting machine with a pattern attachment according to the present invention utilizing eight yarn feed speeds.

DETAILED DESCRIPTION OF THE INVENTION

Figures 1, 5:
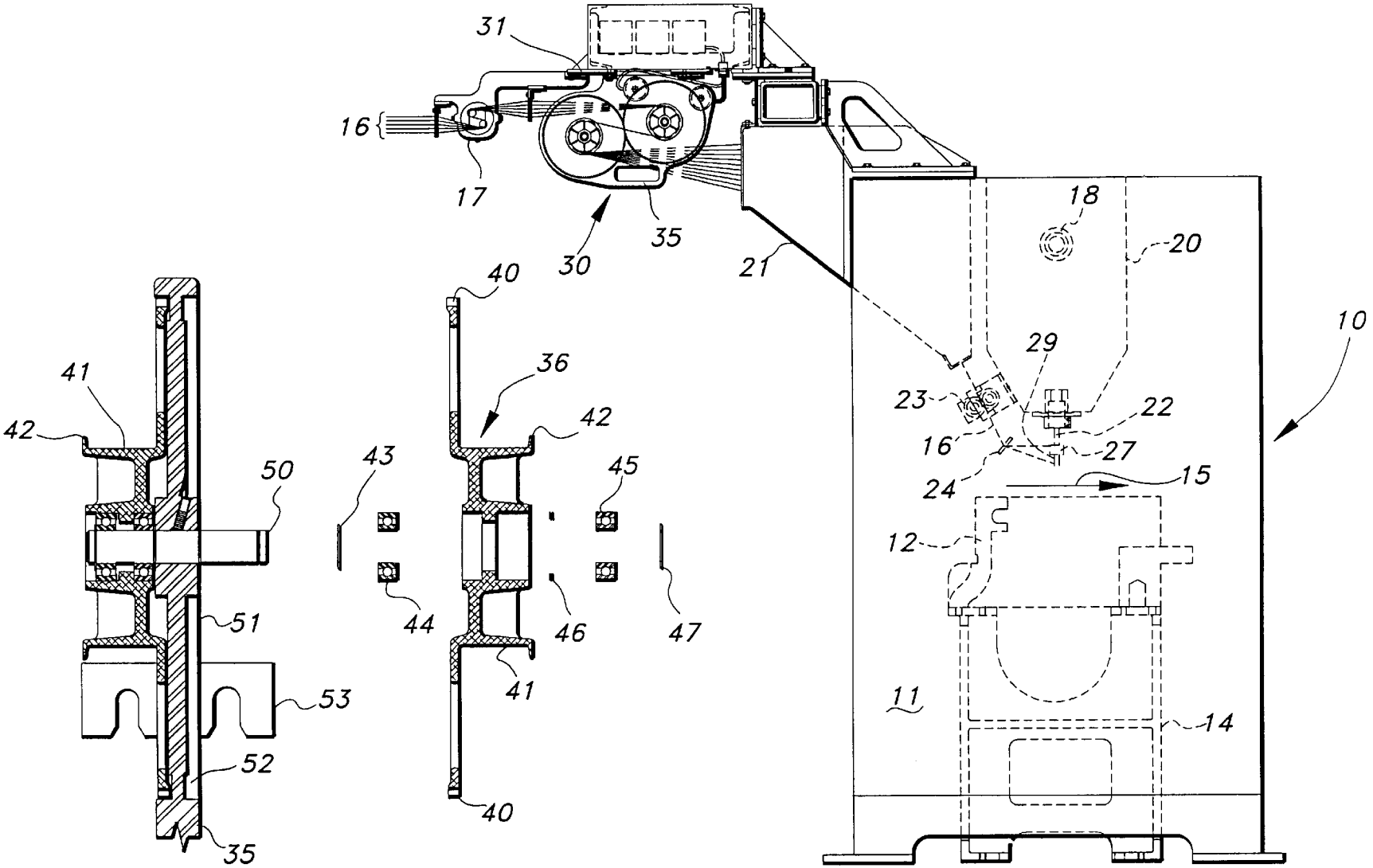
FIG. 1 is a side elevation of a multiple needle tufting machine incorporating a yarn feed mechanism made in accordance with the invention.
FIG. 5 is a sectional view of the transverse support of FIG. 2 taken along the line 5—5 with one yarn feed roll shown in an exploded view.
Figure 4:
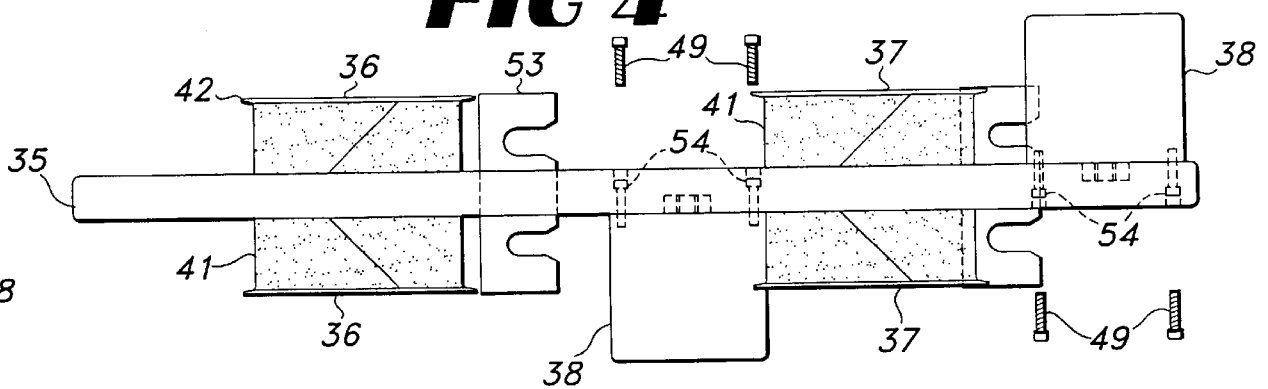
FIG. 4 is a bottom elevation view of the transverse support of FIG. 2.

Referring to the drawings in more detail, FIG. 1 discloses a multiple needle tufting machine 10 upon which is mounted a pattern control yarn feed attachment 30 in accordance with this invention. It will be understood that it is possible to mount attachments 30 on both sides of a tufting machine 10 when desired. The machine 10 includes a housing 11 and a bed frame 12 upon which is mounted a needle plate for supporting a base fabric adapted to be moved through the machine 10 from front to rear in the direction of the arrow 15 by front and rear fabric rollers. The bed frame 12 is in turn mounted on the base 14 of the tufting machine 10.

Figure 6:
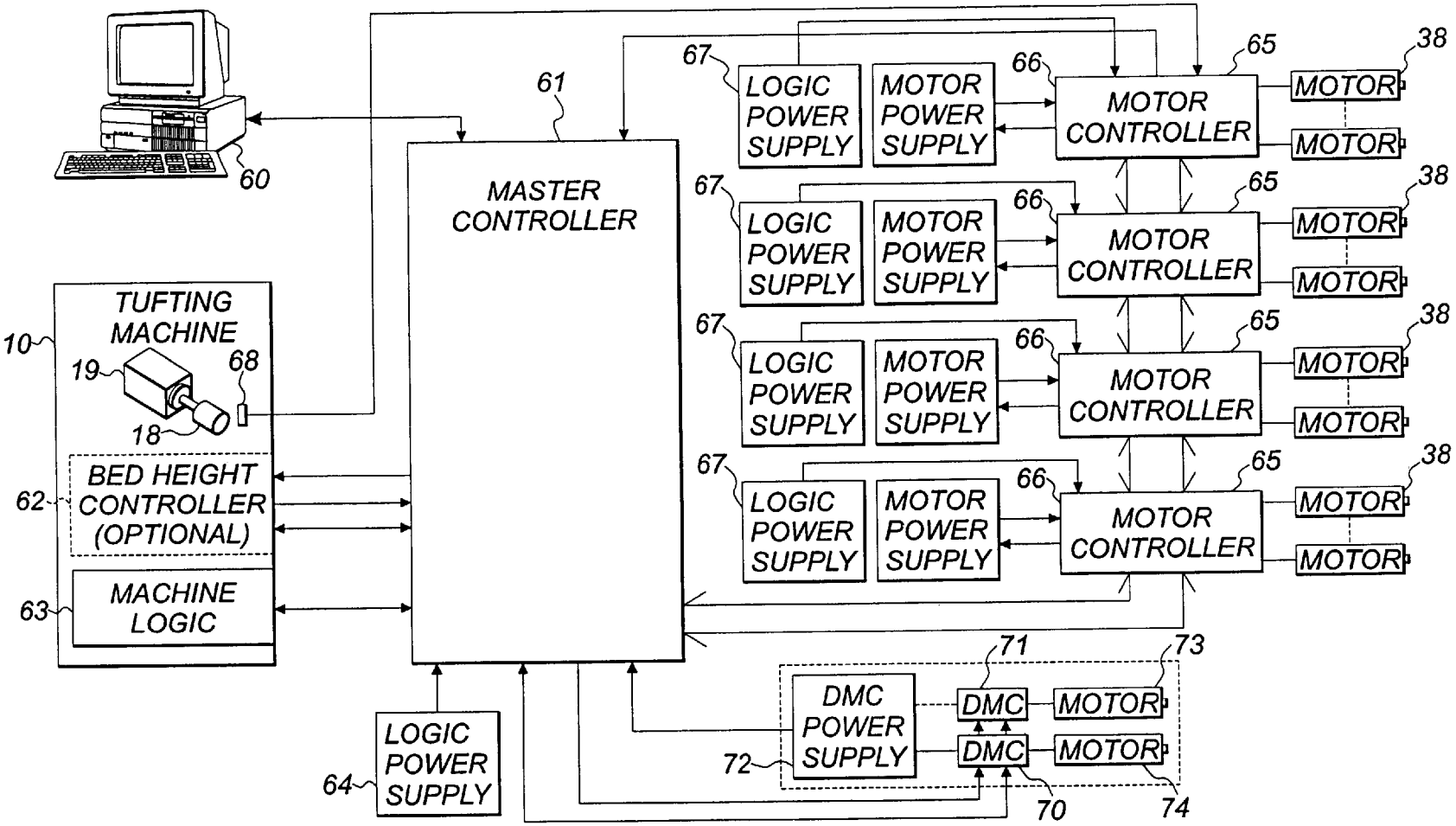
FIG. 6 is a schematic view of the electrical flow diagram for a multiple needle tufting machine incorporating a yarn feed mechanism made in accordance with the invention.

A main drive motor 19 schematically shown in FIG. 6 drives a rotary main drive shaft 18 mounted in the head 20 of the tufting machine. Drive shaft 18 in turn causes push rods 22 to move reciprocally toward and away from the base fabric. This causes needle bar 27 to move in a similar fashion. Needle bar 27 supports a plurality of preferably uniformly spaced needles 29 aligned transversely to the fabric feed direction 15. The needle bar 27 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 16 are fed through tension bars 17, pattern control yarn feed device 30, and tube bank 21. Then yarns 16 are guided in a conventional manner through yarn puller rollers 23, and yarn guides 24 to needles 29. A looper mechanism, not shown, in the base 14 of the machine 10 acts in synchronized cooperation with the needles 29 to seize loops of yarn 16 and form cut or loop pile tufts, or both, on the bottom surface of the base fabric in well known fashions.

In order to form a variety of yarn pile heights, a pattern controlled yarn feed mechanism 30 incorporating a plurality of pairs of yarn feed rolls adapted to be independently driven at different speeds has been designed for attachment to the machine housing 11 and tube bank 21.

Figure 2:
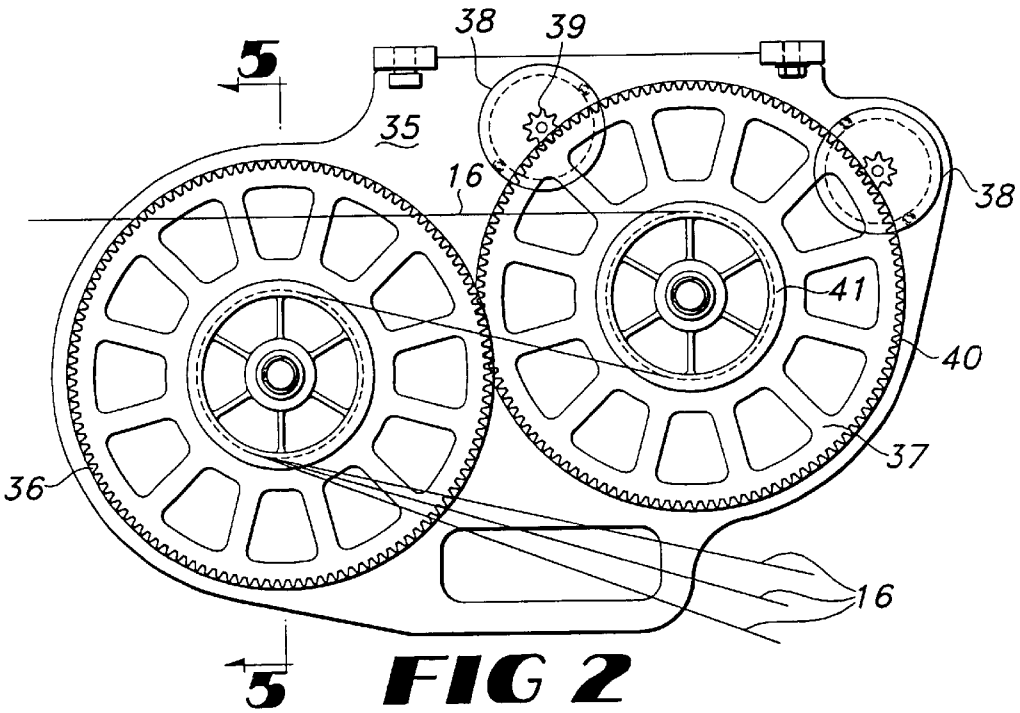
FIG. 2 is a side elevation view of a transverse support holding a set of yarn feed rolls and the servo motor which controls their rotation.

As best disclosed in FIG. 1, a transverse support plate 31 extends across a substantial length of the front of tufting machine 10 and provides opposed upwards and downwards facing surfaces. On the upwards facing surface are placed the electrical cables and sockets to connect with servo motors 38. On the downwards facing surface are mounted a plurality of yarn feed roller mounting plates 35, shown in isolation in FIG. 2. Mounting plates 35 have connectors such as feet 53 to permit the plates 35 to be removably secured to the support plate 31 of the yarn feed attachment. Mounted on each side of each mounting plate 35 are a front yarn feed roll 36, a rear yarn feed roll 37 and a servo motor 38.

Each yarn feed roll 36, 37 consists of a relatively thin gear toothed outer section 40 which on rear yarn feed roll meshes with the drive sprocket 39 of servo motor 38. In addition, the gear toothed outer sections 40 of both front and rear yarn feed rolls 36, 37 intermesh so that each pair of yarn feed rolls 36, 37 are always driven at the same speed. Yarn feed rolls 36, 37 have a yarn feeding surface 41 formed of sand paper-like or other high friction material upon which the yarns 16 are threaded, and a raised flange 42 to prevent yarns 16 from sliding off of the rolls 36, 37. Preferably yarns 16 coming from yarn guides 17 are wrapped around the yarn feeding surface 41 of rear yarn roll 37, thence around yarn feeding surface 41 of front yarn roll 36, and thence into tube bank 21. Because of the large number of independently driven pairs of yarn feed rolls 36, 37 that can be mounted in the yarn feed attachment 30, it is not anticipated that more than about 12 yarns would need to be driven by any single pair of rolls, which is a much lighter load providing relatively little resistance compared to the hundred or more individual yarns that might be carried by a pair of rolls on a roll type yarn feed attachment, and the thousand or more individual yarns that might be powered by a single drive shaft on some stitches in a traditional scroll-type attachment. By providing the servo motors 38 with relatively small drive sprockets 39 relative to the outer toothed sections 40 of yarn feed rolls 36, 37, significant mechanical advantage is gained. This mechanical advantage combined with the relatively lighter loads, and relatively light yarn feed rolls weighing less than one pound, permits the use of small and inexpensive servo motors 38 that will fit between mounting plates 35. This permits direct drive connection with the yarn feed rolls 36, 37 rather than a 90° connection as would be required if larger servo motors were used that sat upon the top of mounting plates 35. Preferably the gear ratio between yarn feed rolls 36, 37 and the drive sprocket 39 is about 15 to 1 with the yarn feed rolls 36, 37 each having 120 teeth and the drive sprocket 39 having 8 teeth. Satisfactory results can generally be obtained if the ratio is as low as 12 to 1 and as high as 18 to 1. However, when the ratio is lower than 8 to 1 or higher than 24 to 1, it is no longer feasible to drive the yarn feed rolls as shown.

Figure 3:
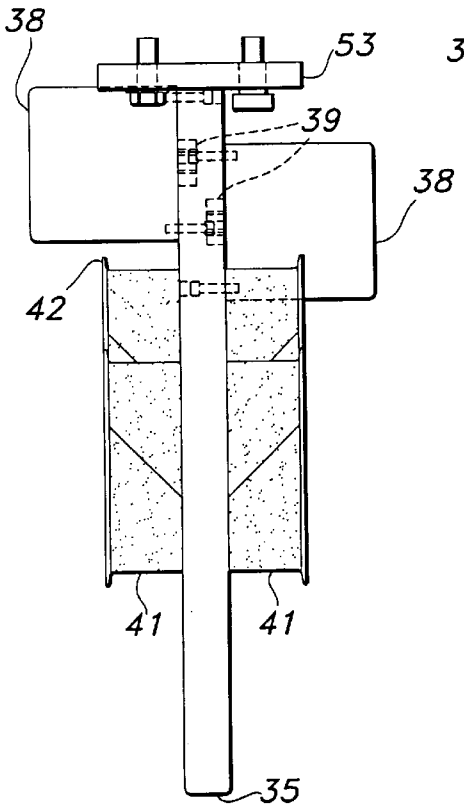
FIG. 3 is a rear elevation view of the transverse support of FIG. 2.

As is best illustrated in FIG. 5, mounting plates 35 have hollow circular sections 51 to receive the outer toothed section 40 of the yarn feed rolls 36, 37. The outer edge 52 of such circular sections 51 is deeper to receive the slightly thicker toothed sections 40. The drive sprockets 39 are also similarly received, as shown in FIG. 3, so that the intermeshing drive teeth are substantially concealed within mounting plates 35 and the chance of yarns 16 or other material becoming inadvertently entangled in the yarn feed drive is thereby minimized. A fixed pin 50 is set through each mounting plate 35 and yarn feed rolls 36, 37 are permitted to rotate freely about the pin 50, on bearings 44, 45. Preferably a retaining ring 43 and bearing 44 are mounted on the pin 50 adjacent to the mounting plate 35, then the yarn feed roll is mounted, followed by a wave spring 46, another bearing 45, and an outer retaining ring 47. Servo motors 38 are fastened to mounting plates 35 by threaded screws 49, which pass through apertures 54 in the mounting plate 35, and are received in the base of the servo motors 38.

Turning now to FIG. 6, a general electrical diagram of the invention is shown in the context of a computerized tufting machine. A personal computer 60 is provided as a user interface, and this computer 60 may also be used to create, modify, display and install patterns in the tufting machine 10 by communication with the tufting machine master controller 61. Master controller 61 in turn preferably interfaces with machine logic 63, so that various operational interlocks will be activated if, for instance, the controller 61 is signaled that the tufting machine 10 is turned off, or if the "jog" button is depressed to incrementally move the needle bar, or a housing panel is open, or the like. Master controller 61 may also interface with a bed height controller 62 on the tufting machine to automatically effect changes in the bed height when patterns are changed. Master controller 61 also receives information from encoder 68 relative to the position of the main drive shaft 18 and preferably sends pattern commands to and receives status information from controllers 70, 71 for backing tension motor 74 and backing feed motor 73 respectively. Said motors 73, 74 are powered by power supply 72. Finally, master controller 61, for the purposes of the present invention, sends ratio metric pattern information to motor controllers 65. For instance, the master controller 61 might signal a particular motor controller 65 that it needs to rotate its corresponding servo motor 38 through 8.430 revolutions for the next revolution of the main drive shaft 18.

Motor controllers 65 also receive information from encoder 68 relative to the position of the main drive shaft 18. Motor controllers 65 process the ratiometric information from master controller 61 and main drive shaft positional information from encoder 68 to direct corresponding motors 38 to rotate yarn feed rolls 36, 37 the distance required to feed the appropriate yarn amount for each stitch. Motor controllers 65 preferably utilize only 5 volts of current for logic power supplies 67, just as master controller 61 utilizes power supply 64. In the preferred construction, motor power supplies 66 need provide no more than 100 volts of direct current at two amps peak. The system described enables the use of hundreds of possible yarn feed rates, preferably 128, 256 or 512 yarn feed rates, and can be operated at speeds of 1500 stitches per minute. The cost of motor controller 65 is minimized and throughput speed maximized by implementing the necessary controller logic in hardware, utilizing logic chips and programmable logical gate array chips.

The preferred yarn feed servo motors 38 are trapezoidal brushless motors having a height of no more than about 3.5 inches. Such motors also preferably provide motor controllers 65 with commutation information from Hall Effect Detectors (HEDs) and additional positional information from encoders, where the HEDs and encoders are contained within the motors 38. The use of a commutation section and encoder within the servo motor avoids the necessity of using a separate resolver to provide positional control information back to a servo motor controller as has been the practice in typical prior art computerized tufting machines exemplified by Taylor, U.S. Pat. No. 4,867,080.

In commercial operation, it is anticipated that broadloom tufting machines will utilize pattern controlled yarn feed devices 30 according to the present invention with 60 mounting plates 35, thereby providing 120 pairs of independently controlled yarn feed rolls 36, 37. If any pair of yarn feed rolls 36, 37 or associated servo motor 38 should become damaged or malfunction, mounting plate 35 can be easily removed by loosing bolts attaching mounting feet 53 to the transverse support plate 31 and unplugging connections to the two servo motors 38 that are secured to the mounting plate 35. A replacement mounting plate 35 already fitted with yarn feed rolls 36, 37 and servo motors 38 can be quickly installed. This allows the tufting machine to resume operation while repairs to the damaged or malfunctioning yarn feed rolls and motor are completed, thereby minimizing machine down time.

The present yarn feed attachment 30 provides substantially improved results when using tube banks specially designed to take advantage of the attachment's 30 capabilities. Historically, tube banks have been designed in three ways. Originally, the tubes leading from yarn feed rolls to a needle were made the minimum length necessary to transport the yarn to the desired location as shown in J. L. Card, U.S. Pat. No. 2,862,465. Due to the friction of the yarns against the tubes, this had the result of feeding more yarn to the needles associated with relatively short tubes and less yarn to the needles associated with relatively long tubes, and with uneven finishes resulting on carpets tufted thereby.

To eliminate this effect, tube banks were then designed so that every tube in the tube bank was of the same length. On a broad loom tufting machine, this typically required that there be over 1400 tubes each approximately 18 feet long, or approximately 25,000 feet of tubing. The collective friction of the yarns passing through these tubes created other problems and a third tube bank design evolved as a compromise.

In the third design, all of the yarn feed tubes from a given pair of yarn feed rolls had the same length. Thus all of the yarn feed tubes leading from the yarn feed rolls in the center of the tufting machine would be about 10½ feet long. At the edges of the tufting machine, all of the tubes leading from the yarn feed rolls would be approximately 18 feet long. A tube bank constructed in this fashion requires slightly less than 20,000 feet of tubing, over a 20% reduction for the uniform 18 foot long tubes of the second design.

While this third design was thought to be the optimal compromise between tufting evenly across the entire machine and minimizing friction, the present yarn feed attachment has shown this is not the case. In fact when yarns are all fed through 18 foot tubes from the left hand side of the tufting machine, the yarn tubes going to the right hand side of the machine are straighter than the yarn tubes that are conveying the yarns only a few feet to needles on the left hand side of the machine. As a result, the yarns passing through relatively straighter tubes are fed slightly more yarn. This discrepancy became particularly noticeable when utilizing the present attachment 30 which allows the yarns from each pair of yarn feed rolls 36, 37 to be independently controlled. As a result, a new fourth tube bank design is new preferred in which the longest length of tubing required for yarns being fed from the center of the tufting machine is utilized as the minimum tubing length for any yarn. This length is approximately 10½ feet on a broadloom machine. The result is that the yarn tubes spreading out from the center of the tufting machine are all about 10½ feet long while yarn tubes spreading from an end of the tufting machine range between 10½ feet and about 18 feet in length. This reduces the total length of tubing in the tube bank to approximately 17,000 feet, a savings of approximately 32% in total tube length.

When the present yarn feed attachment 30 is used with a tube bank of any of the above designs, improved tufting performance can be realized. This is because in the traditional scroll attachment all yarns being fed high are fed at the same rate regardless of whether the yarns are centrally located, or located at an end of the tufting machine. In the fourth design, this leads to centrally located yarns going through 10½ feet tubes and tufting a standard height (S) as they are distributed across the width of the carpet. However, yarns being distributed from the right end of the tufting machine will pass through 10½ foot tubes at the right side of the tufting machine and will tuft the standard height (S), but will pass through tubes approaching 18 feet in length to the left side of tufting machine and so will tuft lower due to increased friction than the standard height (S-Fr). On the traditional scroll attachment there is no way to minimize this amount (Fr) that the pile height is reduced due to the increased friction against the yarn traveling in longer tubes. However, with the present attachment, the yarns distributed from the right end of the machine can be fed slightly faster so that the yarns distributed to the center of the tufting machine will tuft at the standard height (S), the yarns distributed to the right side of the machine will tuft at a slightly increased height (S+½Fr) and the yarns distributed to the left side of the machine will tuft at a height lower than the standard height by only half the amount (S−½Fr) that would occur on the traditional scroll type pattern attachment. By distributing the variation across the entire width of the carpet, the discrepancy is minimized and made much less noticeable and detectable.

In an improved version of the present attachment 30, software can be provided that requires the operator to set the yarn feed lengths for the center yarn feed rolls and the yarn feed rolls at either end of the tufting machine. Thus on a 120 roll attachment, the operator might set the yarn feed lengths for the 61st pair of yarn feed rolls 36, 37 for the 120th pair. If the yarn feed length for a high stitch was 1.11 inches for the 61st pair and 1.2 inches for the 120th pair of yarn feed rolls 36, 37, then the software would proportionally allocate this 0.1 inch difference across the intervening 58 sets of yarn feed rolls. Thus, in the hypothetical example above, the following pairs of yarn feed rolls would automatically feed the following lengths of yarn for a high stitch once the lengths for the 61st pair and 120th pair of yarn feed rolls were set by the operator:

| YARN FEED ROLL PAIR NUMBERS | LENGTH OF YARN FEED |
|---|---|
| 1–6 and 115–120 | 1.2 inches |
| 7–12 and 109–114 | 1.19 inches |
| 13–18 and 103–108 | 1.18 inches |
| 19–24 and 97–102 | 1.17 inches |
| 25–30 and 91–96 | 1.16 inches |
| 31–36 and 85–90 | 1.15 inches |
| 37–42 and 79–84 | 1.14 inches |
| 43–48 and 73–78 | 1.13 inches |
| 49–54 and 67–72 | 1.12 inches |
| 55–66 | 1.11 inches |

Of course, the operator would still be permitted to further adjust the automatic settings if that proved desirable on a particular tufting machine.

Another significant advance permitted by the present pattern control attachment 30 is to permit the exact lengths of selected yarns to be fed to the needles to produce the smoothest possible finish. For instance, in a given stitch in a high/low pattern on a tufting machine that is not shifting its needle bar the following situations may exist:

1. Previous stitch was a low stitch, next stitch is a low stitch.
2. Previous stitch was a low stitch, next stitch is a high stitch.
3. Previous stitch was a high stitch, next stitch is a high stitch.
4. Previous stitch was a high stitch, next stitch is a low stitch.

Obviously, with needle bar shifting which requires extra yarn depending upon the length of the shift, or with more than two heights of stitches, many more possibilities may exist. In this limited example, it is preferable to feed the standard low stitch length in the first situation, to slightly overfeed for a high stitch in the second situation, to feed the standard high stitch length in the third situation, and to slightly underfeed the low stitch length in the fourth case. On a traditional scroll type attachment, the electromagnetic clutches can engage either a high speed shaft for a high stitch or a low speed shaft for a low stitch. Accordingly, the traditional scroll type attachment cannot optimally feed yarn amounts for complex patterns which results in a less even finish to the resulting carpet.

Figure 7:
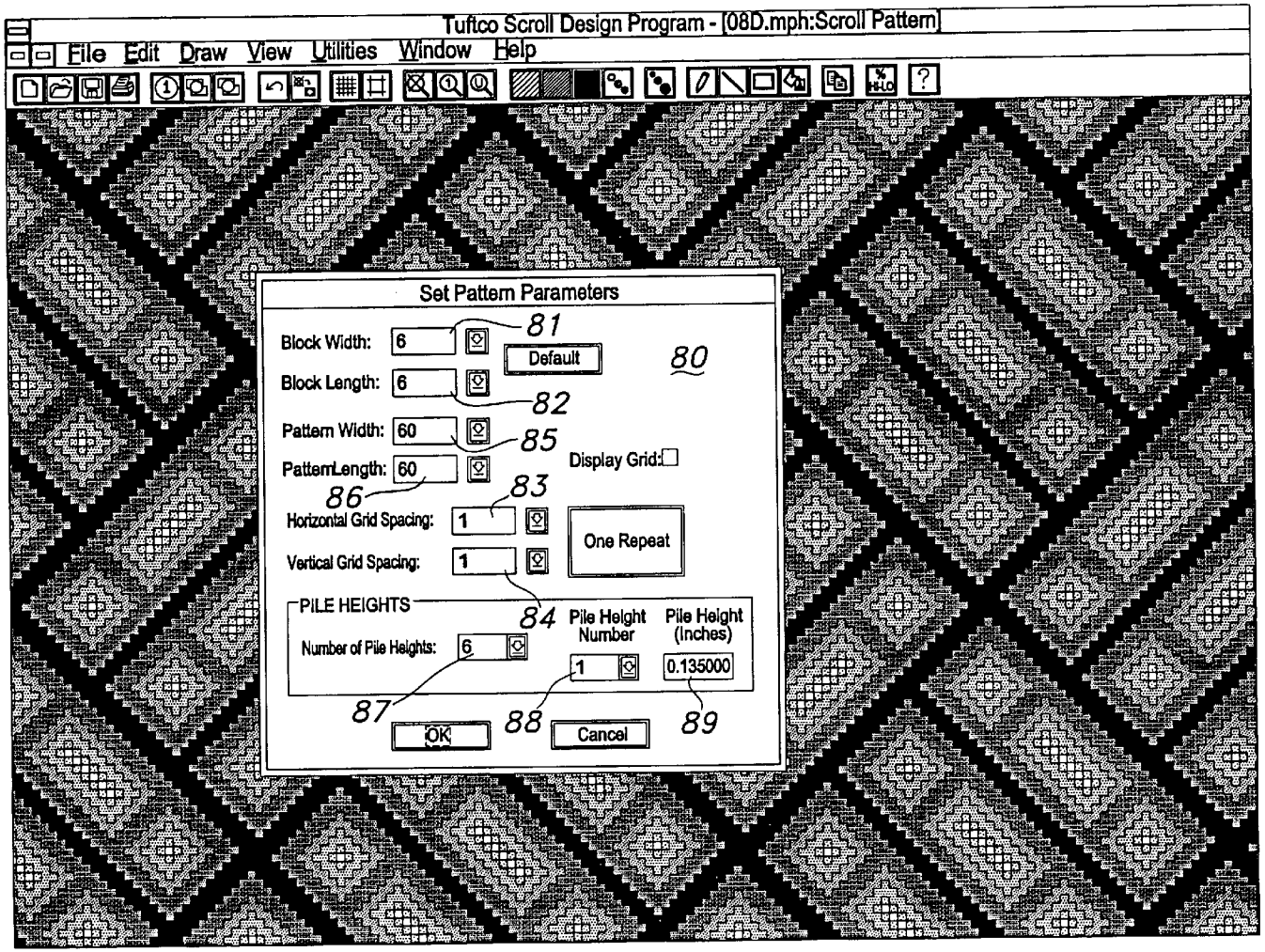
FIG. 7 is an illustration of pattern screen display on a computer workstation utilized to create, modify and display patterns for yarn feed mechanisms made in accordance with the invention.

Many additional pattern capabilities are also present. For instance, by varying the stitch length only slightly from stitch to stitch, this novel attachment will permit the design and tufting of sculptured heights in pile of the carpet. In order to visualize the many variations that are possible, it has proven desirable to create new design methods for the attachment. FIG. 7 displays a representative dialog box 80 that allows the operator at computer 60, or at a stand-alone or networked design computer to select pattern parameters. General screen display parameters are selected such as block width and length 81, 82 grid spacing 83, 84. The width 85 and length 86 of the pattern are also set. Pattern width 85 will generally be 30, 60, or 120 when the design software is used with a 120 yarn feed roll pattern attachment 30 according to the present invention. Pattern length 86 will generally be the same as the pattern width 85 but may be shorter or much longer.

Figure 8:
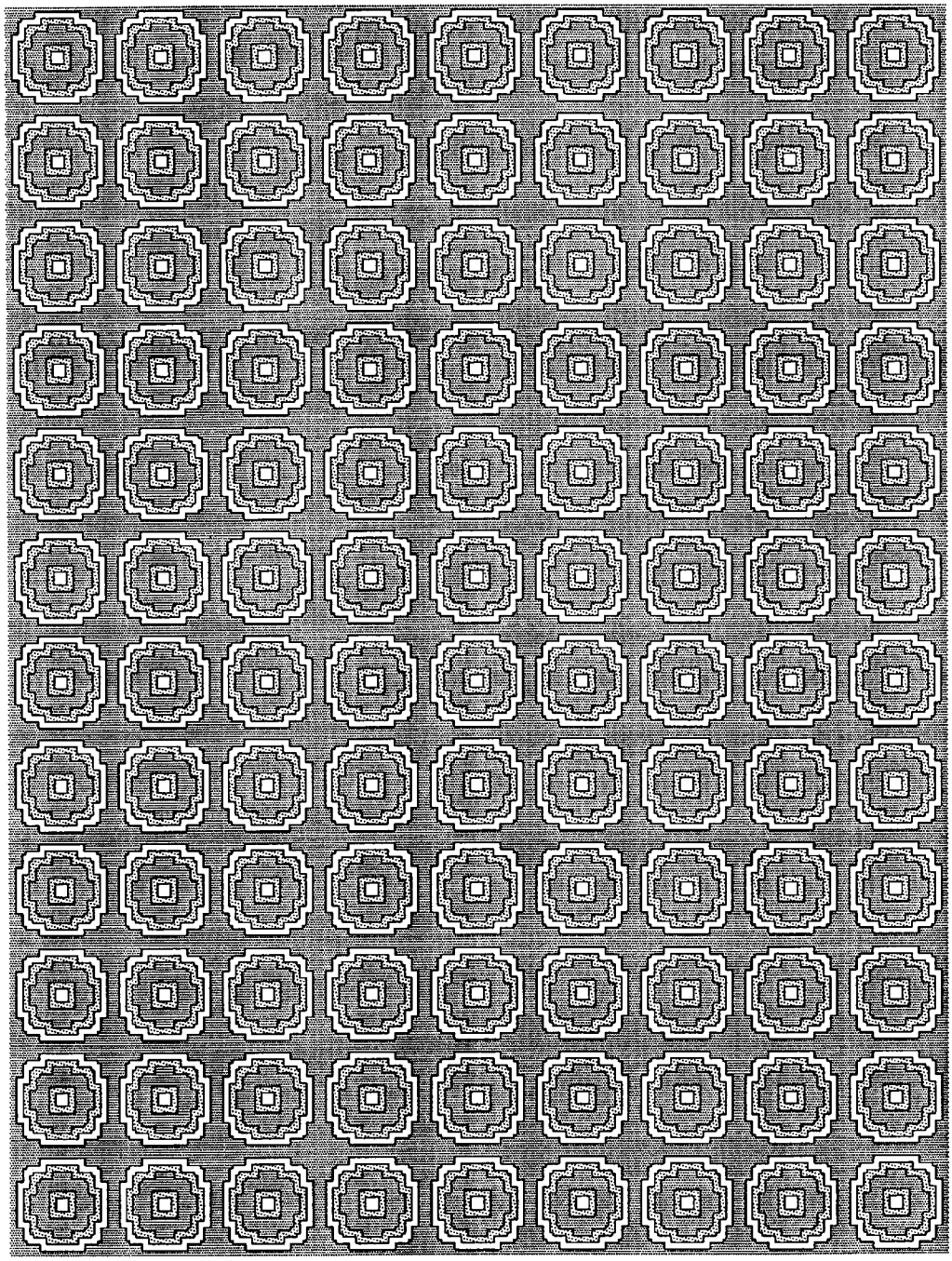
FIG. 8 is an illustration of a pattern created for tufting by a single needle bar without shifting.
Figure 11:
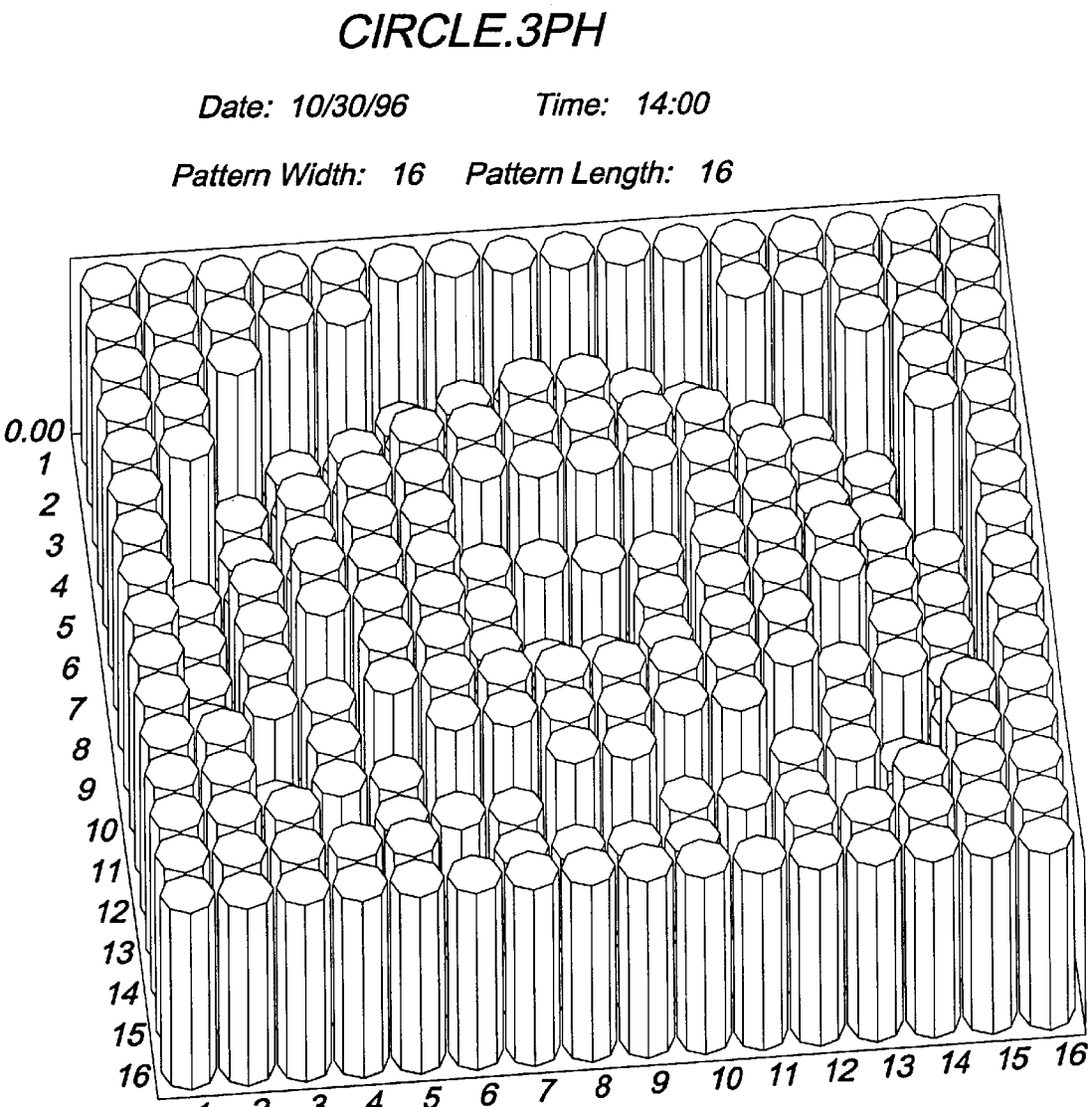
FIG. 11 is a three-dimensional computer screen display of the pattern shown in FIG. 8.

Once the parameters of the screen display and pattern size are selected, the operator inputs the number of pile heights 87 the resulting carpet will have, then individually selects each pile height by number 88, and specifies the corresponding pile height 89. As shown in FIG. 8, each pile height 89 is displayed as a shade of gray (or saturated color), ranging from white 90 for the lowest height to black 95 or a fully saturated color for the highest height. Views of the carpet pattern may be rotated, enlarged, reduced, or provided in 3-dimensional views as shown in FIG. 11 as desired. The operator or designer then can create, or modify a pattern by selecting various of the pile heights and applying them to the display.

A particularly useful feature of the software is that it automatically translates the pile heights in the finished carpet to instructions for the master controller so that the pattern designer does not have to be concerned with whether the needle bar is shifting, whether it is a high stitch after a low stitch or the like. Generally, after processing the raw design information, the software will require more yarn lengths than the number of pile heights the design contains. FIGS. 9 and 10 display representative yarn feed speed and stepping information for the pattern shown in FIG. 8 created with a single needle bar sewing without shifting. FIG. 9 displays the yarn feed speeds that would be used in conventional scroll attachments and with conventional yarn feed pattern programming. FIG. 10 displays selections according to the present invention.

A particularly desirable result of the control over the yarn length of each stitch is a yarn savings of between approximately two and ten percent. This is a result of the yarn feeds for a low stitch after a high stitch being decreased by an amount greater than the increase in yarns fed for a high stitch after a low stitch. For instance, in the pattern of FIG. 8 when using the novel yarn feeds of the present invention shown in FIG. 10, the yarn feed for a low stitch following a high stitch is 0.002 inches—or 0.309 inches less than the yarn fed for a usual low stitch (0.311 inches). However, the yarn feed for high stitch after a low stitch is 1.0 inches or only 0.175 inches more than the yarn fed for a normal high stitch (0.825 inches).

The discrepancy in yarn feed amounts appears to be the result of greater tension being placed on the yarn when transitioning from high to low stitches whereby the yarn is stretched slightly. In the example of FIGS. 8 and 10, 0.134 inches of yarn is saved in each transition from low stitching to high and back to low. Thus patterns with relatively more changes in stitch heights will realize greater economies with the present yarn feed control invention.

The savings realized in the pattern of FIG. 8 may be easily calculated. As shown in FIG. 9, if the pattern is tufted utilizing a prior art yarn feed mechanism providing only three yarn feed speeds, there will be 144 high stitches of 0.825 inches, 56 low stitches of 0.311 inches and 56 medium high stitches of 0.545 inches in each repeat, or a total of 166.736 inches.

However, as shown in FIG. 10, when transition stitches are added in the lengths of 0.002 inches for a low stitch following either a high or medium stitch; of 1.0 inches for a high stitch following a low stitch; of 0.60 inches for a medium stitch following a low stitch; of 0.90 inches for a high stitch following a medium stitch; and of 0.40 inches for a medium stitch following a high stitch, the total yarn consumed in a. repeat is only 160.324 inches. This is a savings of 6.412 inches or almost 4%.

Furthermore, in practice it is useful to use more than one transition stitch. So for instance when transitioning from a high stitch of 0.825 inches to a low stitch of 0.311 inches, the first low stitch for some yarns is preferably fed at about 0.002 inches and the second low stitch is preferably only about 0.08 inches. The third low stitch will assume the regular value of 0.311 inches. Similar over feeds for the transition to high stitches of perhaps 1.0 inches and 0.93 inches would also be made. With the two transition stitch programming, yarn savings for this pattern are even greater. The complexity added by multiple transition stitch values makes the translation of the pile heights of the finished pattern created by the designer to numeric yarn feed values even more complex. A flow chart showing the logic of the substitution of yarn feed values for the high, medium, and low pile heights selected for a given stitch by a designer is shown in FIG. 12.

Pattern information depicting finished yarn pile heights, as by color saturation as shown in FIG. 8 or three-dimensional form as shown in FIG. 11, is input into a computer 60 (shown in FIG. 6), in step 101. In the next step 102, the computer 60 processes the pattern height information for each pattern width position, which is represented by the yarn for a single needle on the tufting machine. Most patterns will have 30, 40, or 60 pattern width or needle positions though the present yarn feed attachment will permit even patterns with 120 positions. When using two yarn feed attachments with separate staggered needle bars, even 240 positions could be created.

Figure 12A:
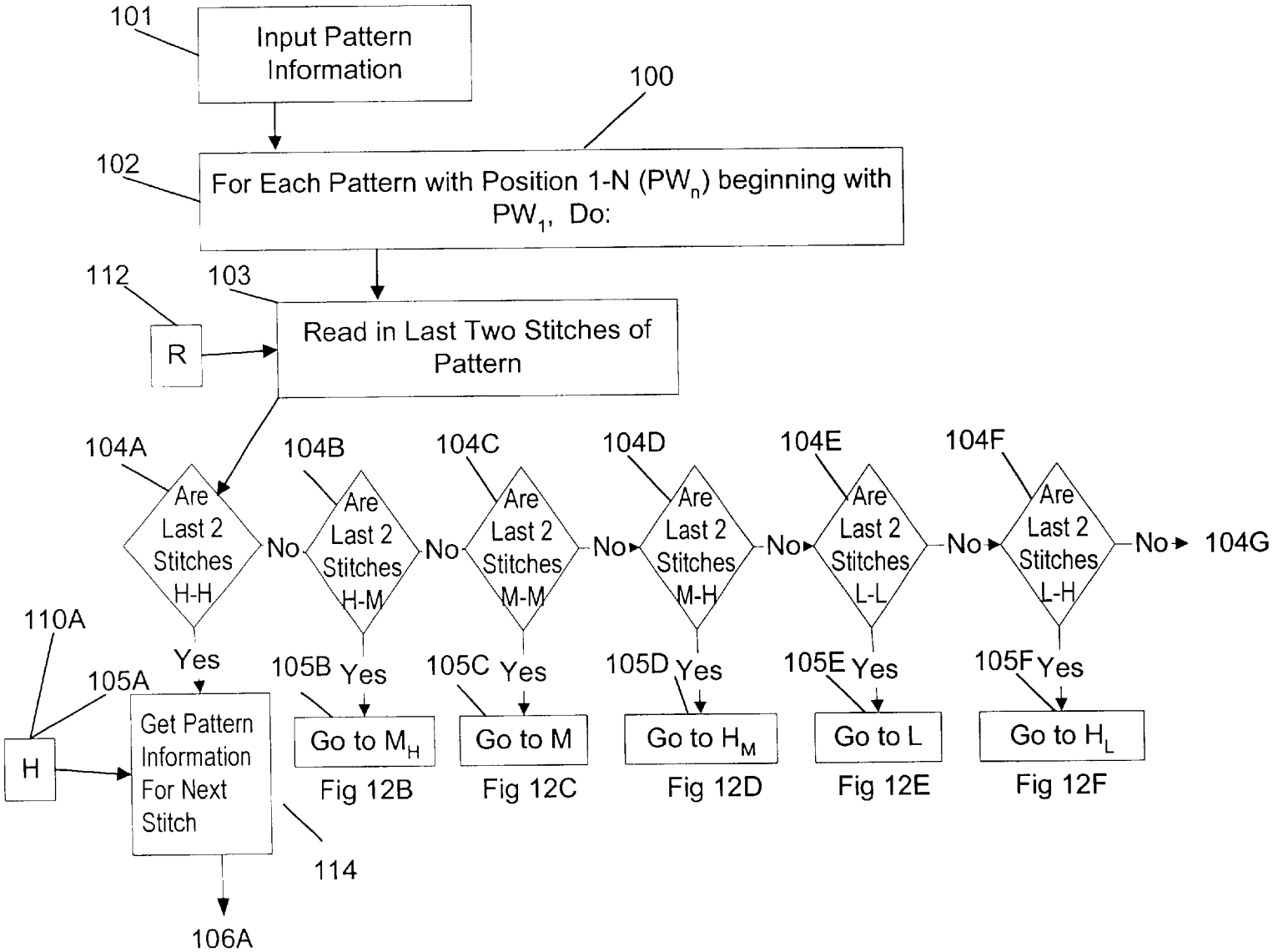
FIGS. 12A–12Z, 12AA, and 12BB constitute a flow chart for the determination of yarn feed values based upon the previous two stitches and the shifting of the needle bar.
Figure 12B:
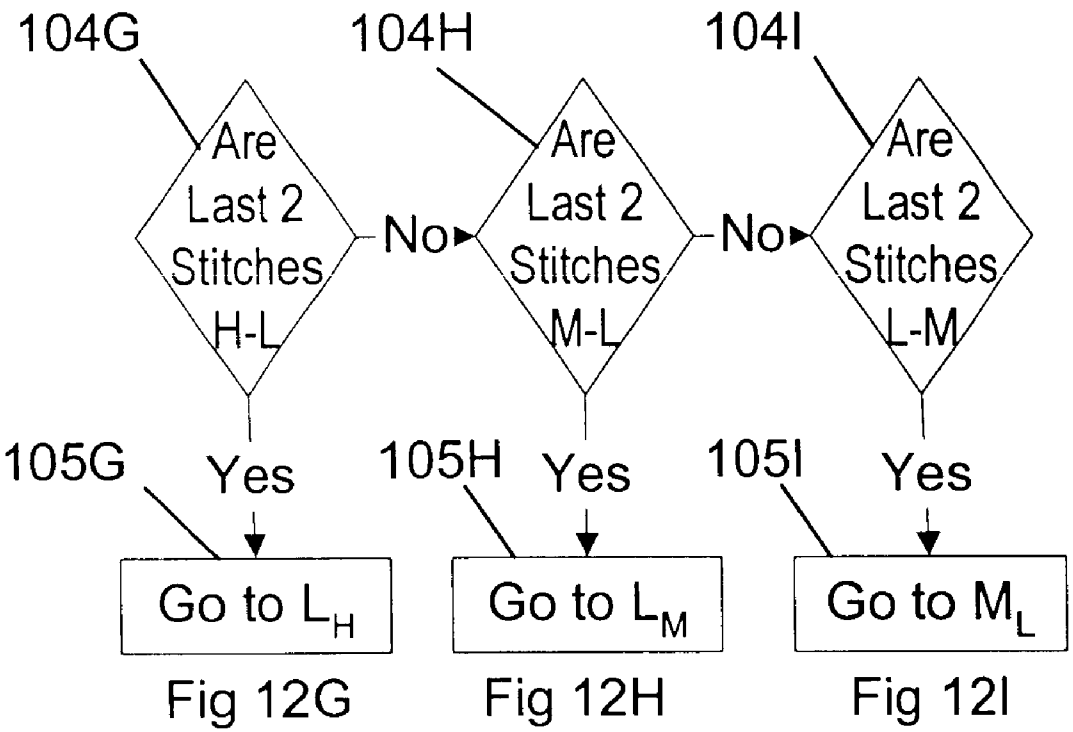
Figure 12C:
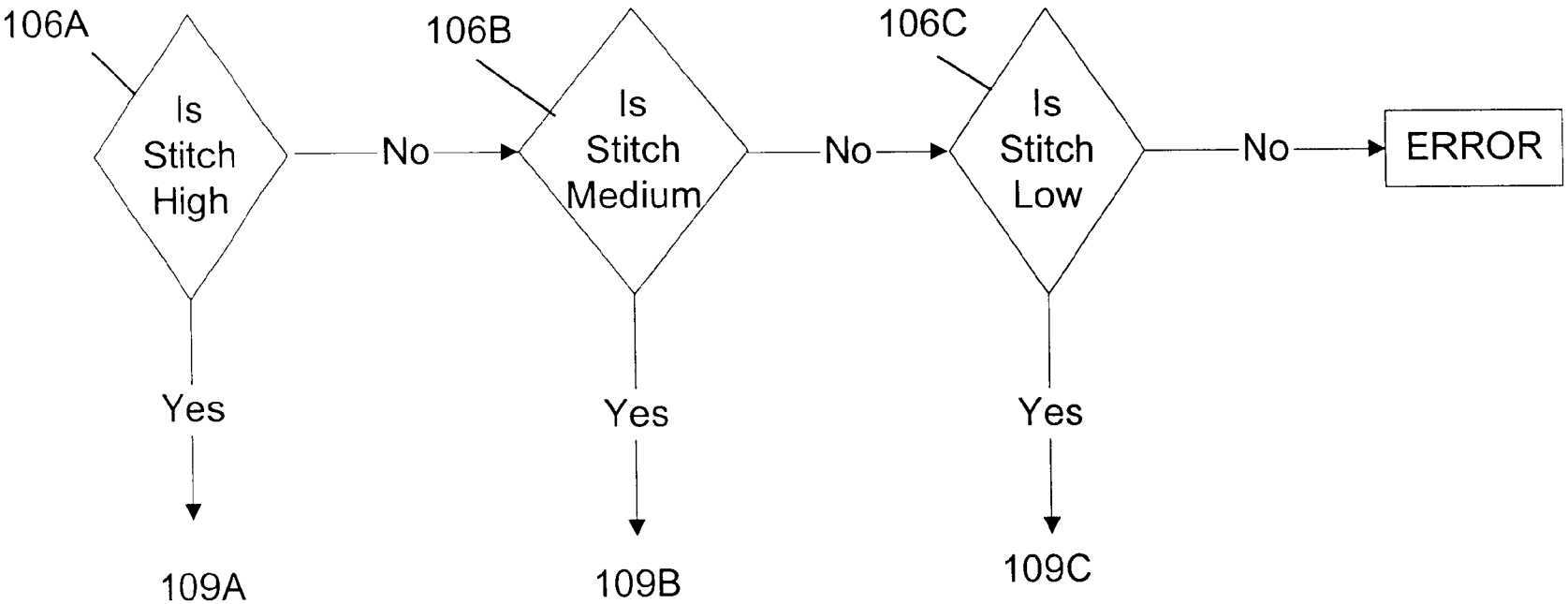
Figure 12D:
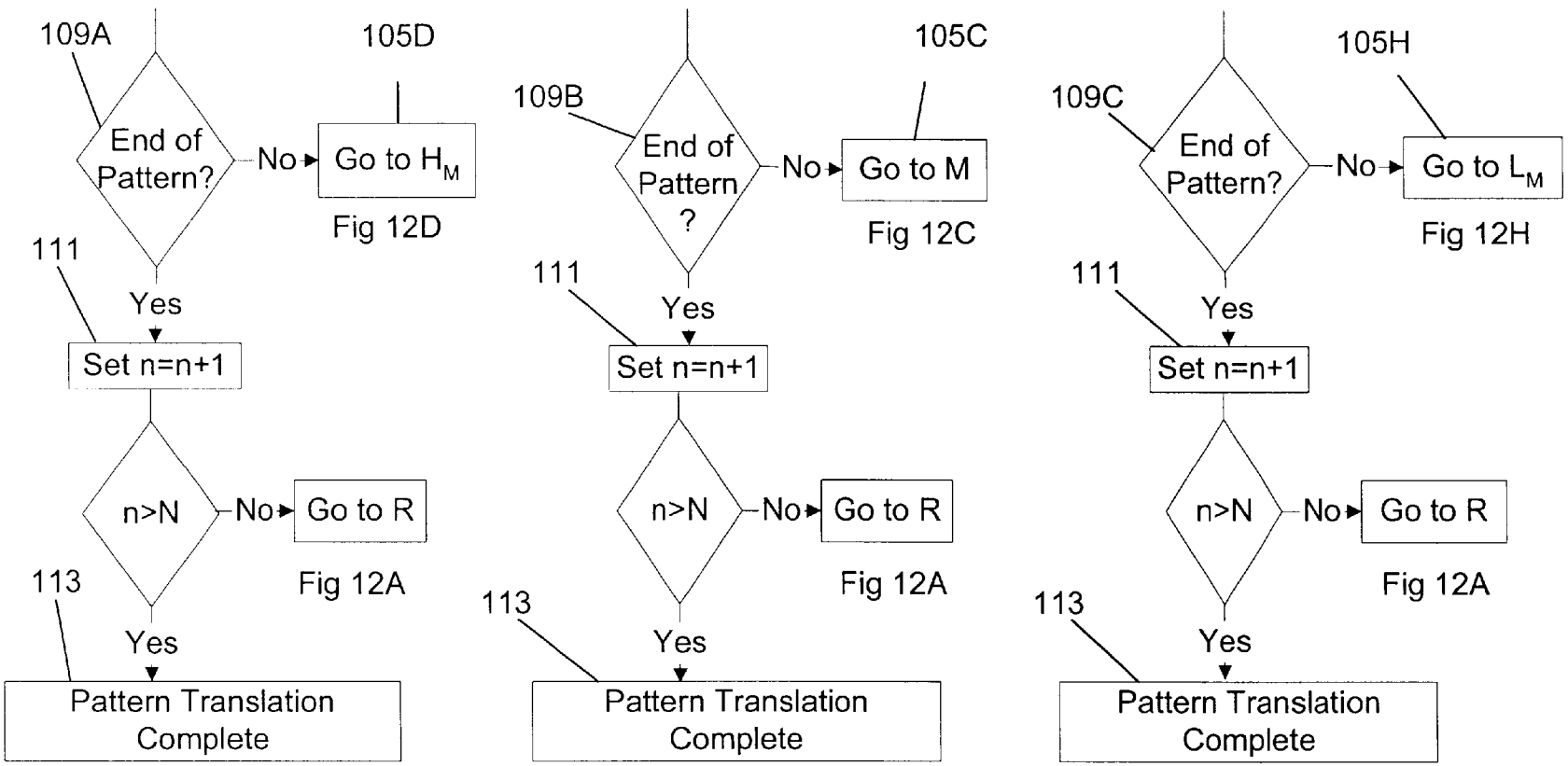
Figure 12E:
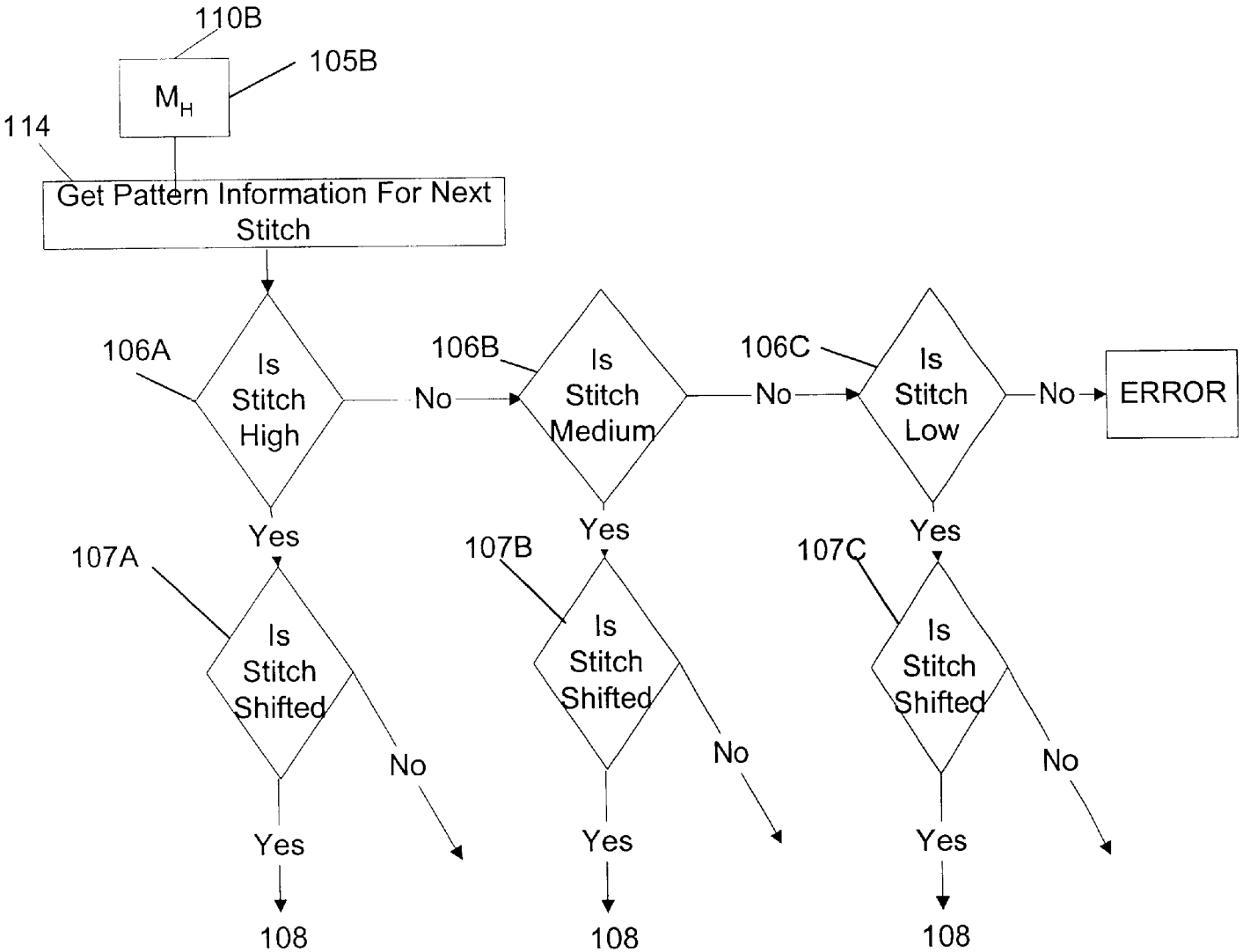
Figure 12F:
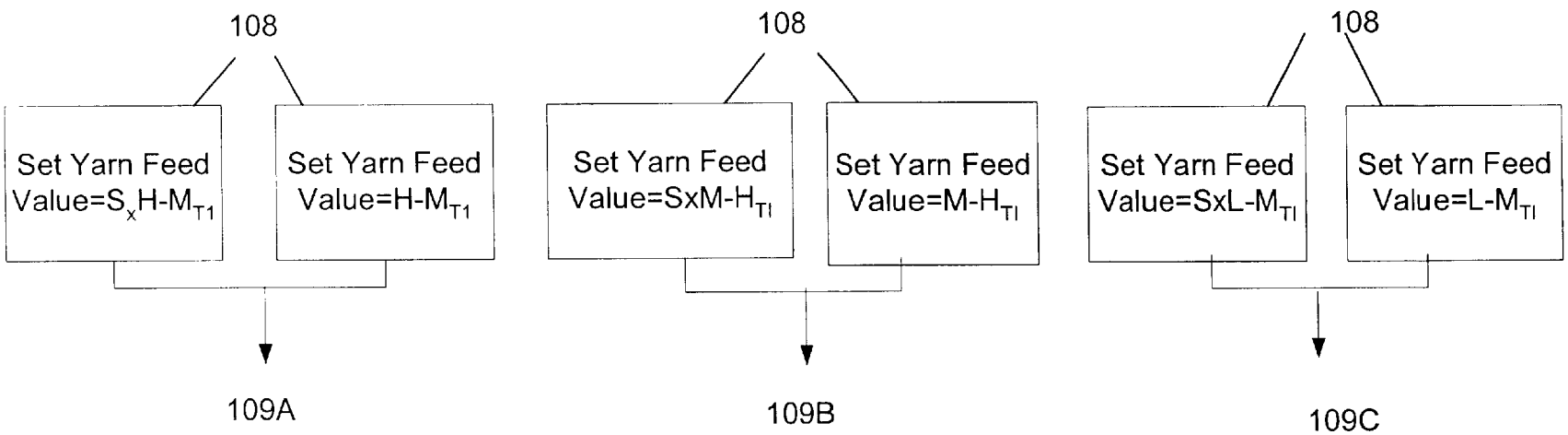
Figure 12G:
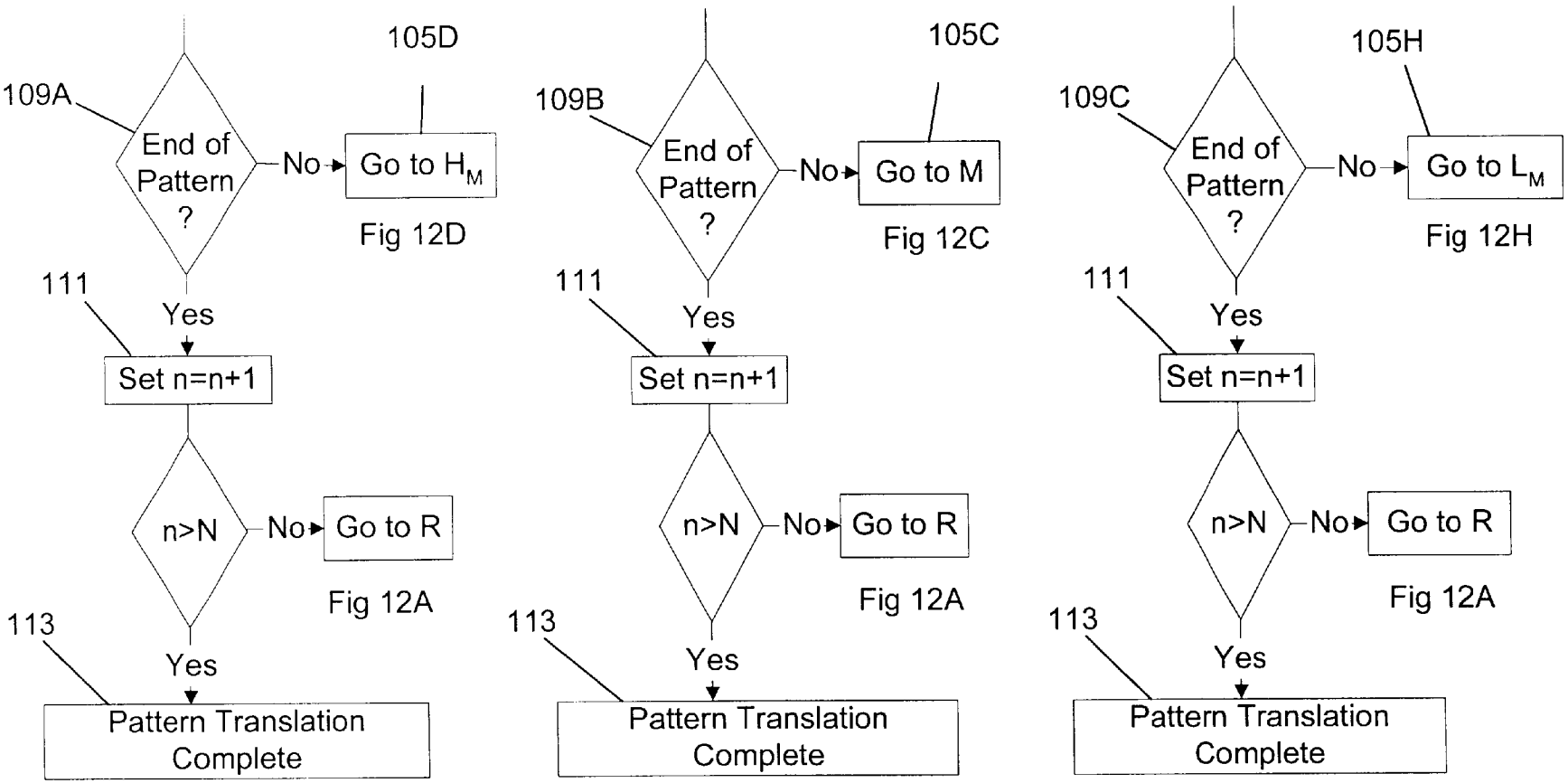
Figure 12H:
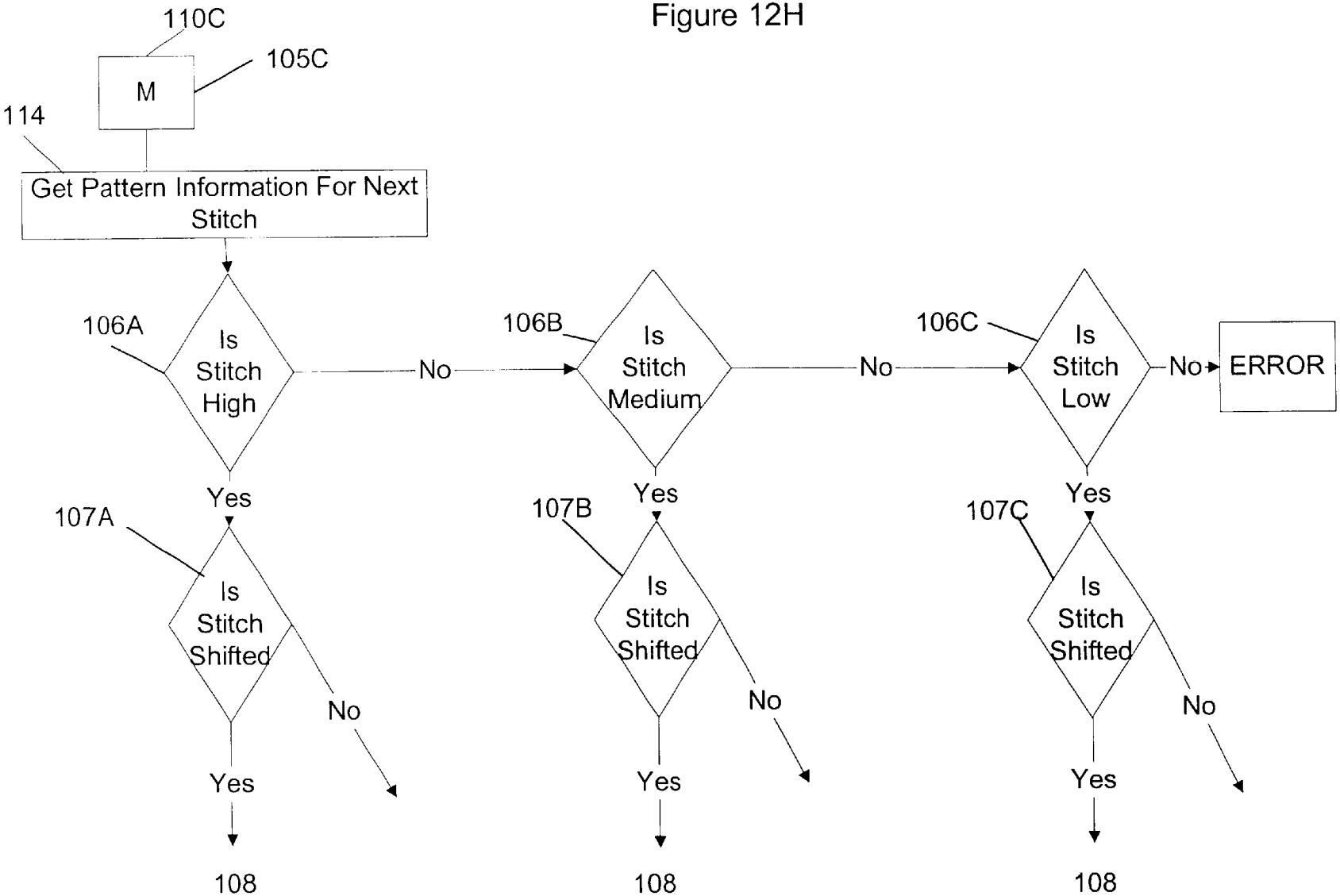
Figure 12I:
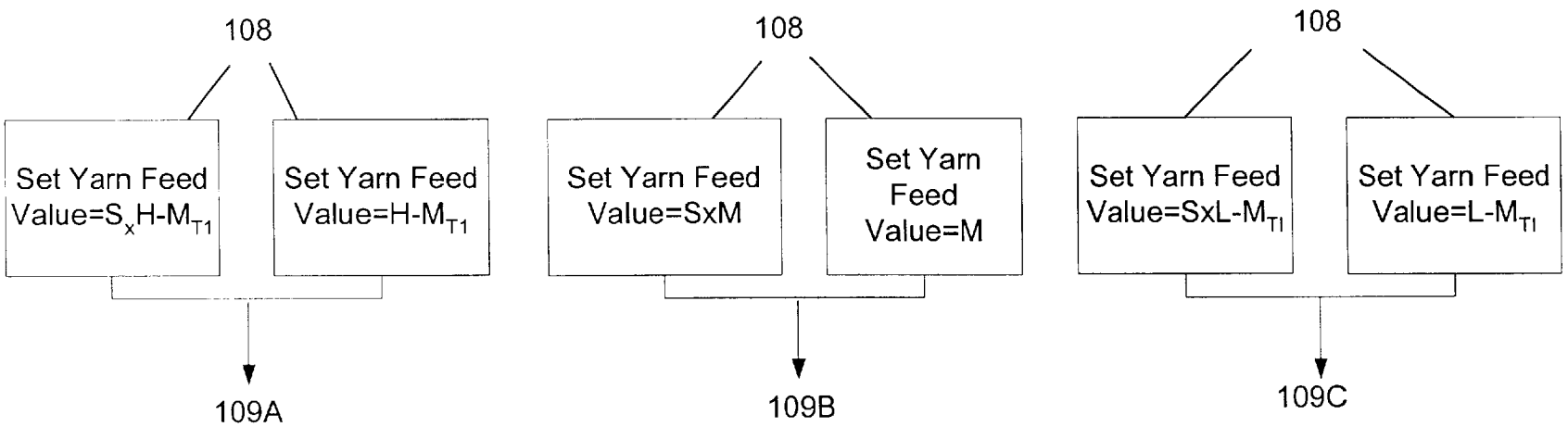
Figure 12J:
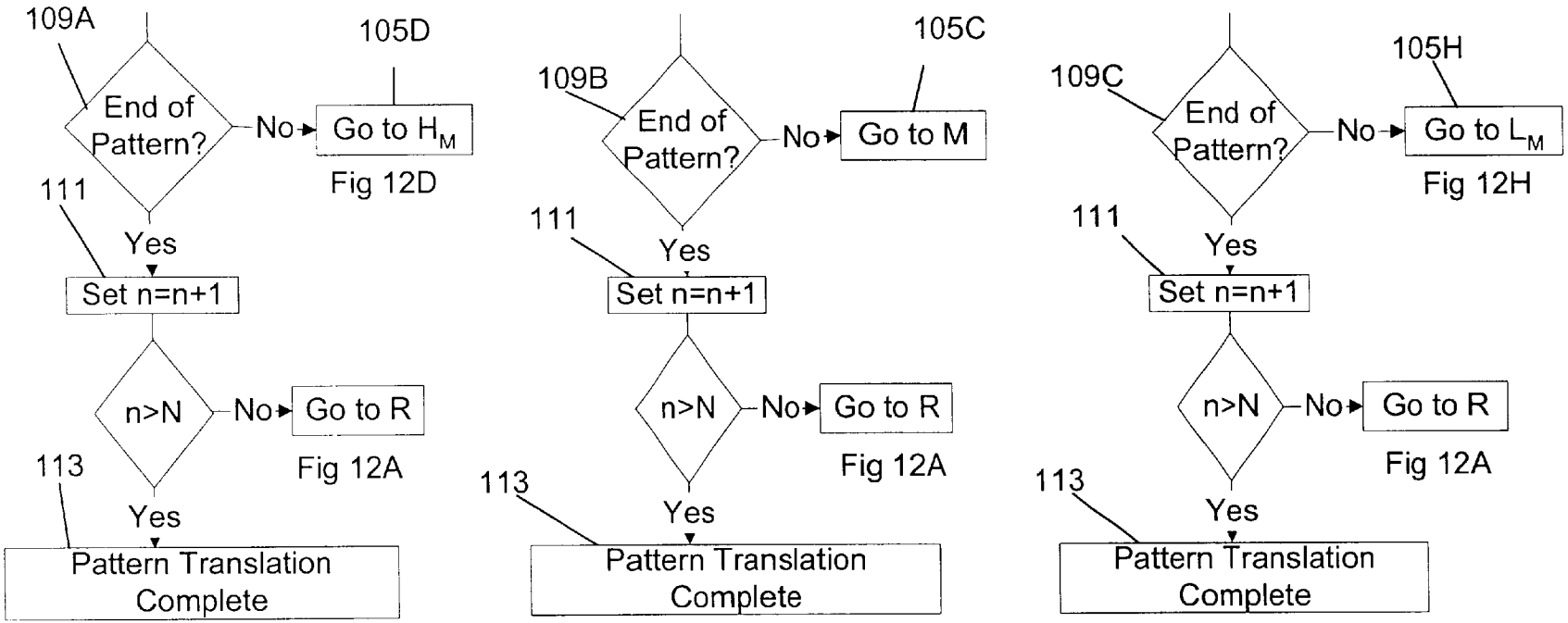
Figure 12K:
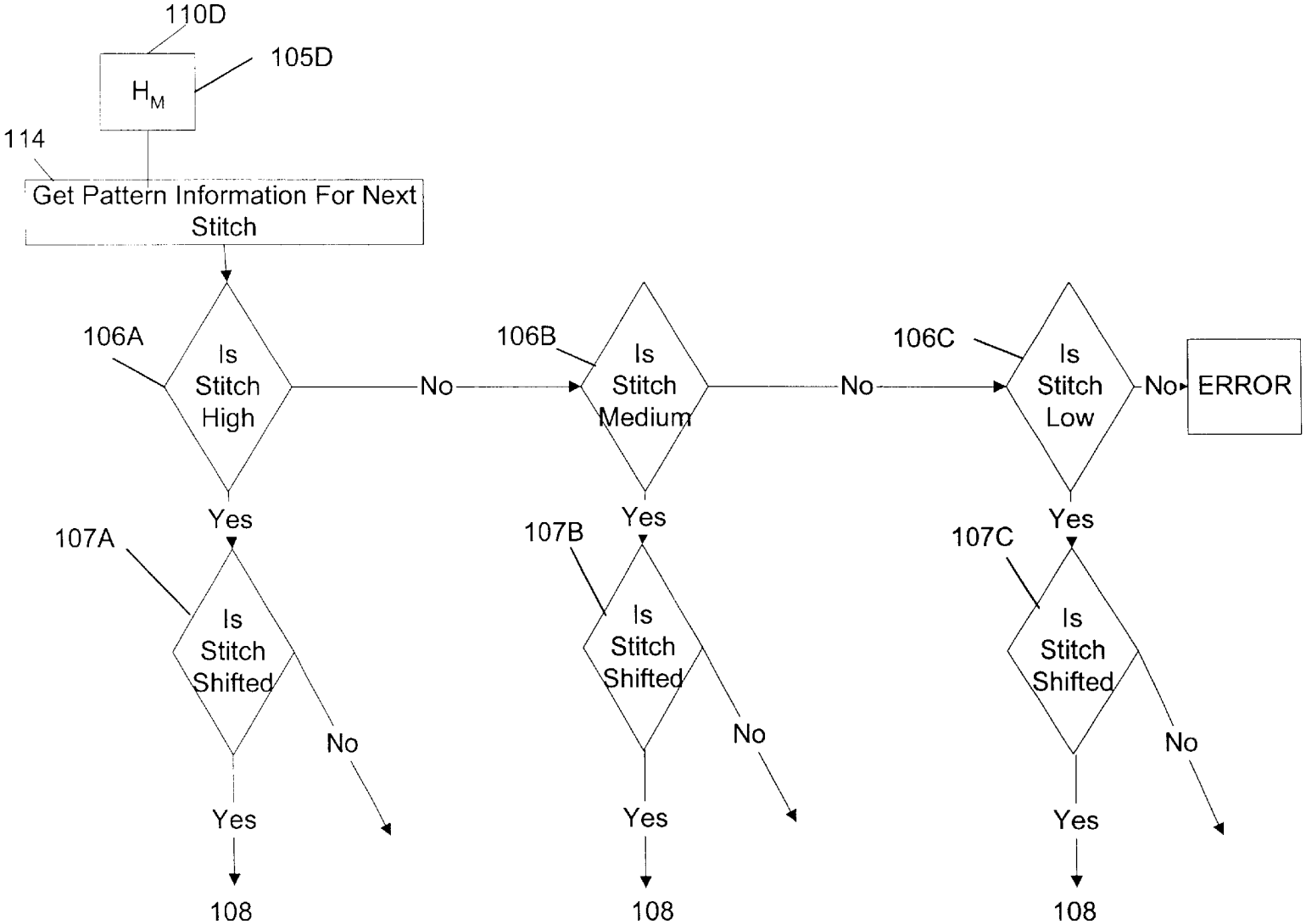
Figure 12L:
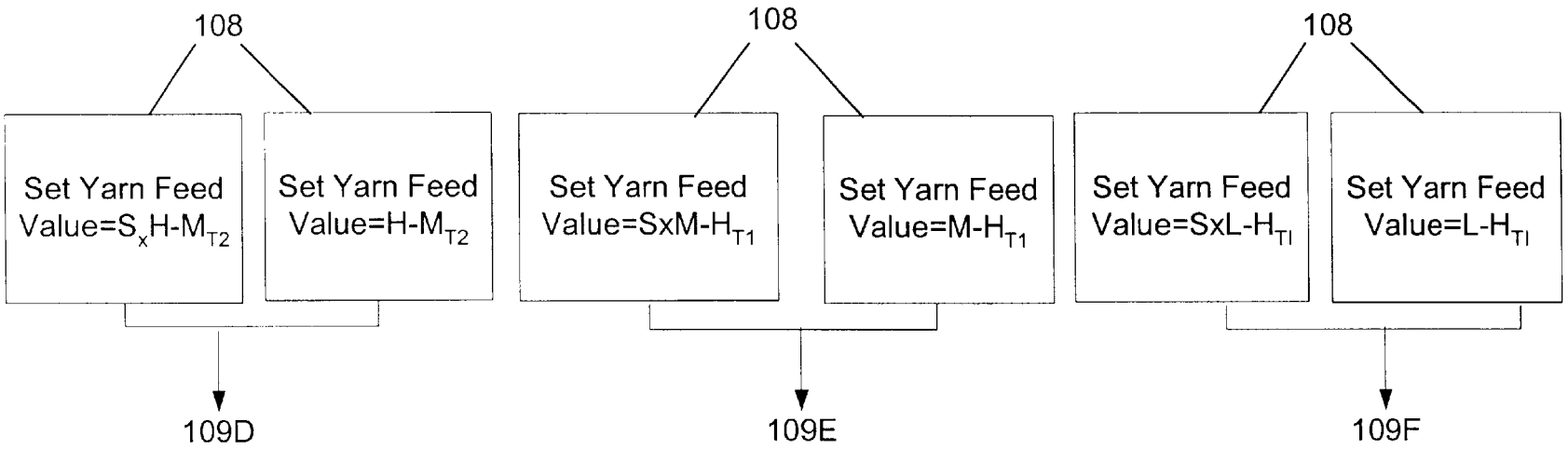
Figure 12M:
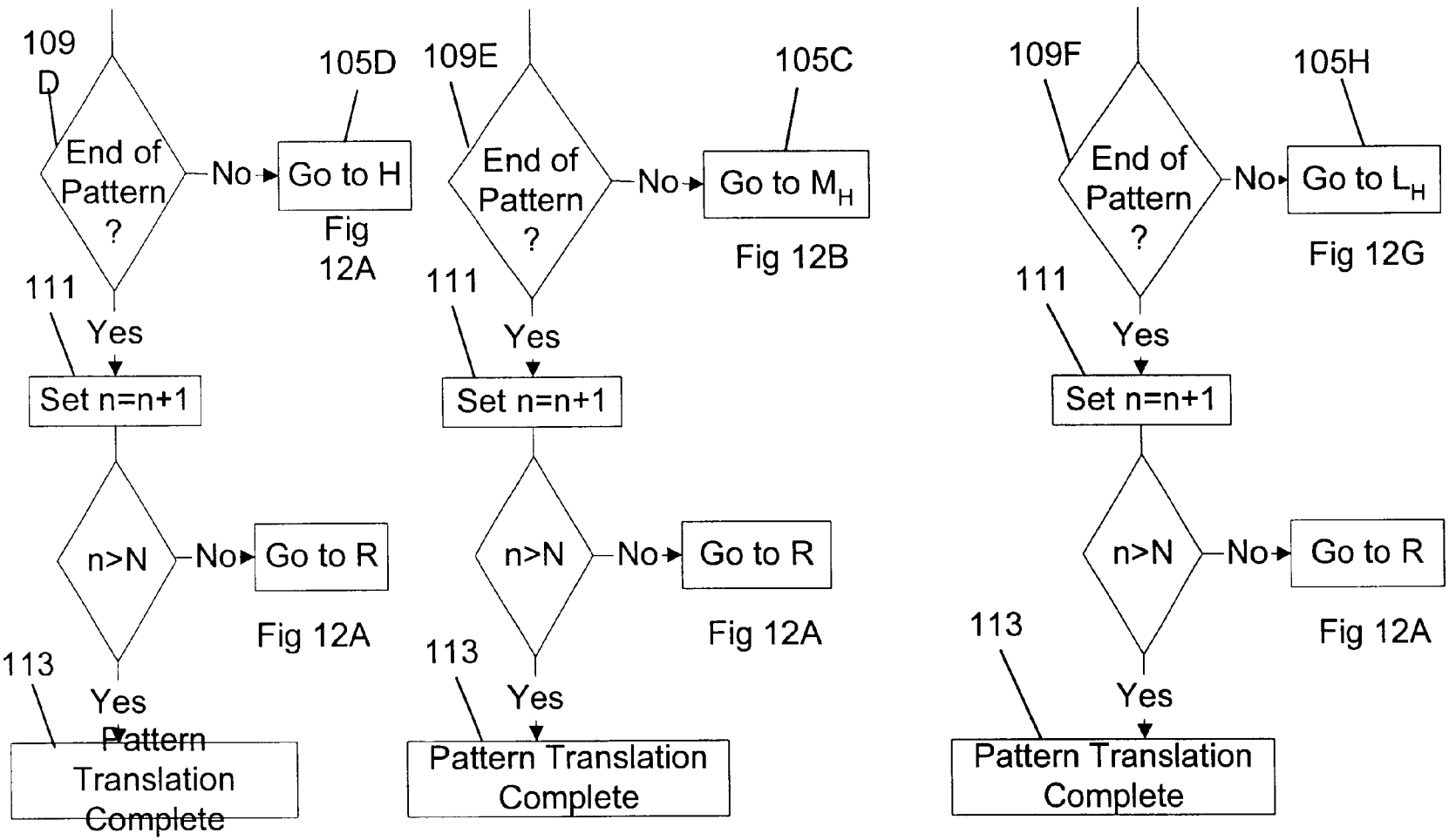
Figure 12N:
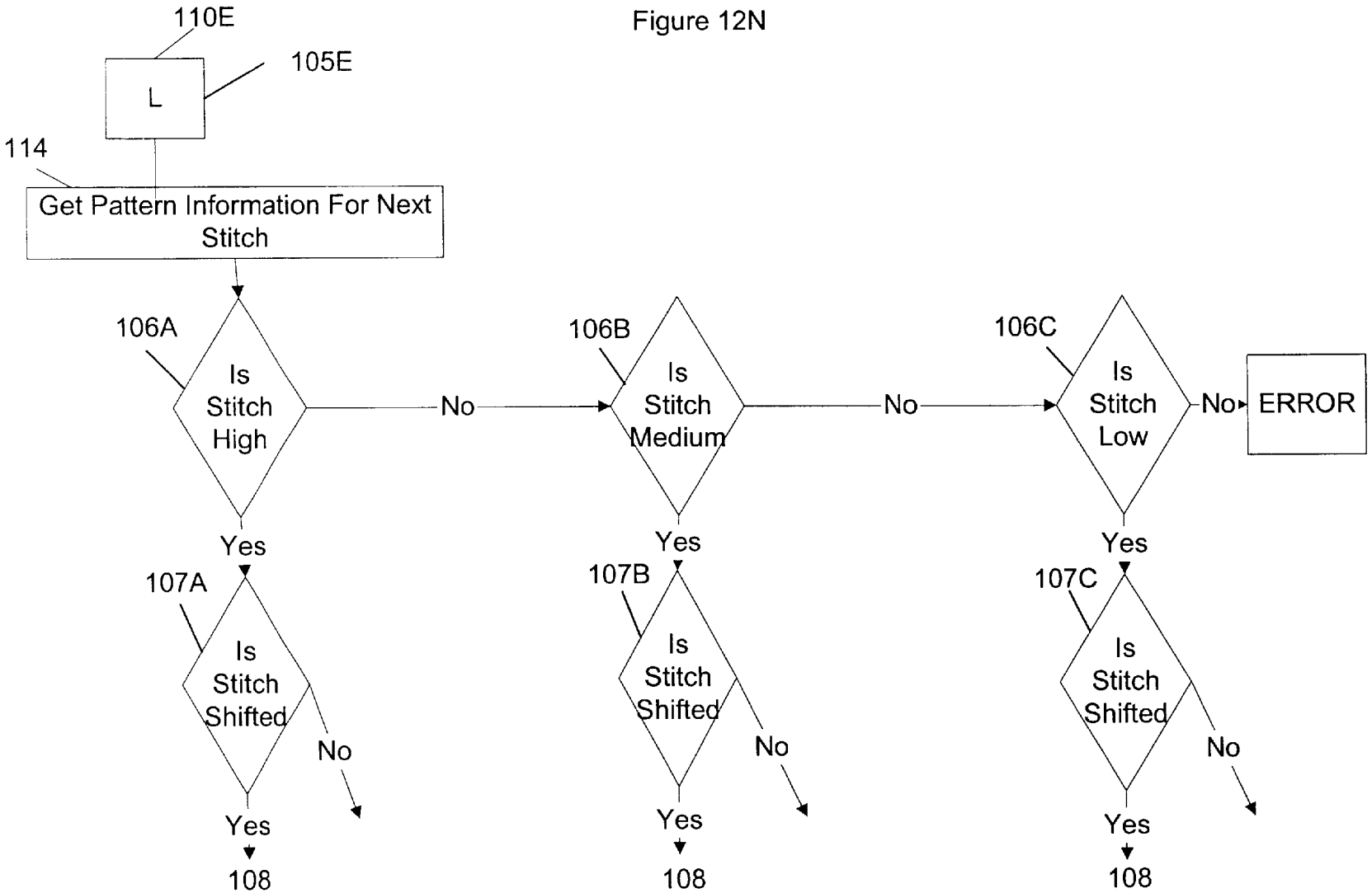
Figure 12O:
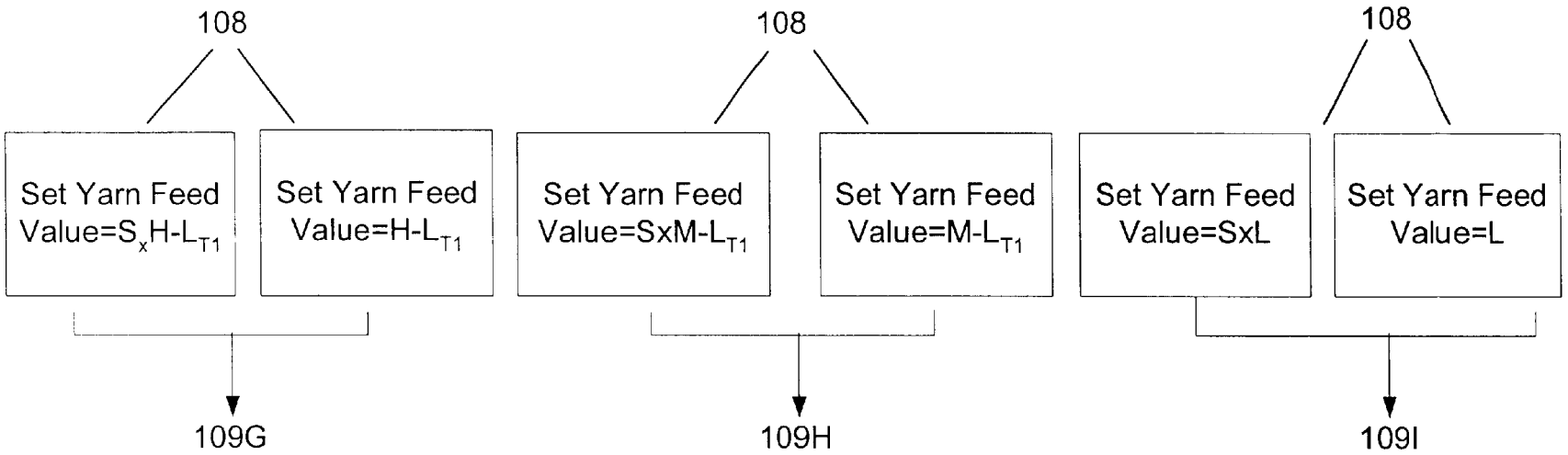
Figure 12P:
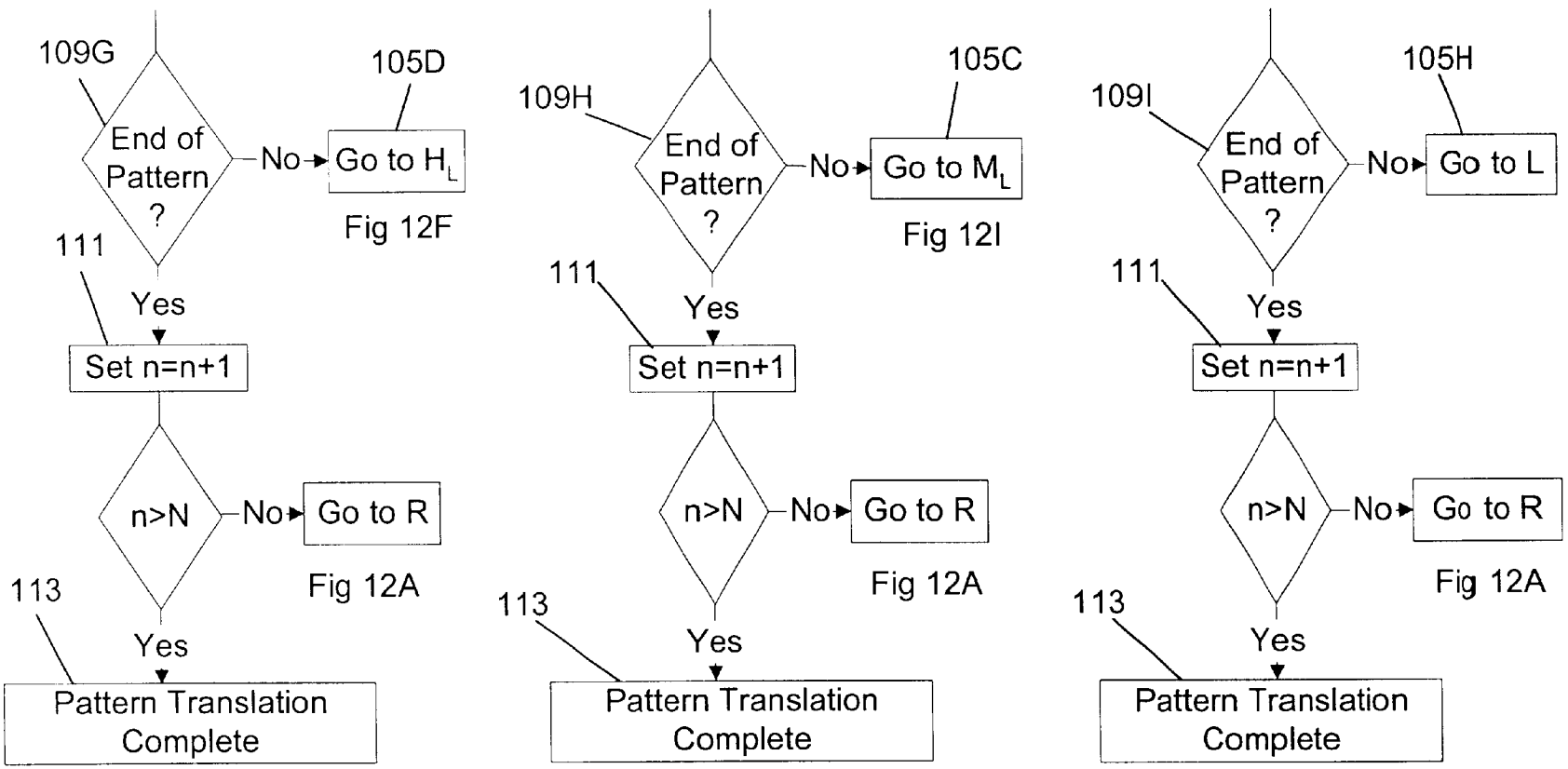
Figure 12Q:
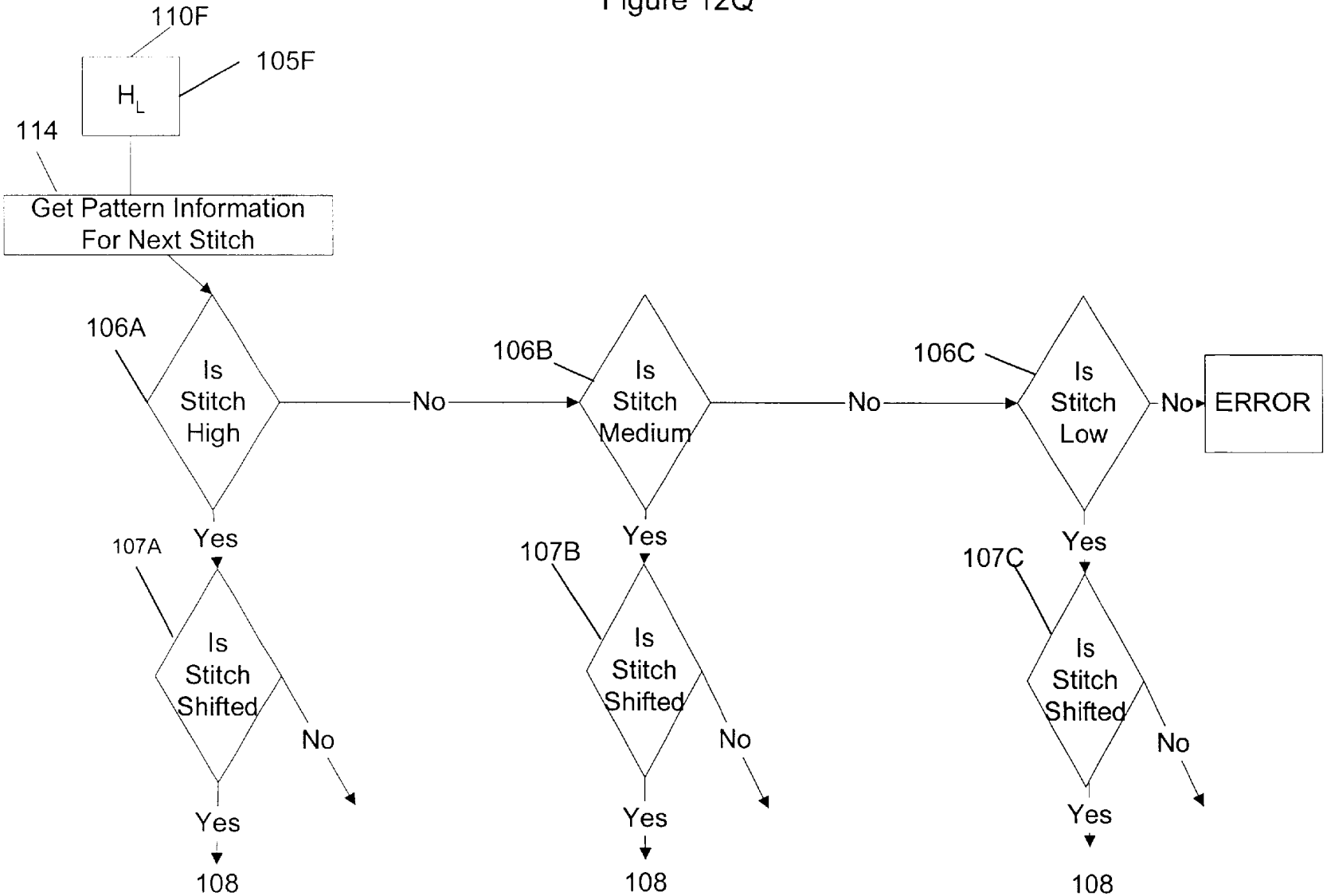
Figure 12R:
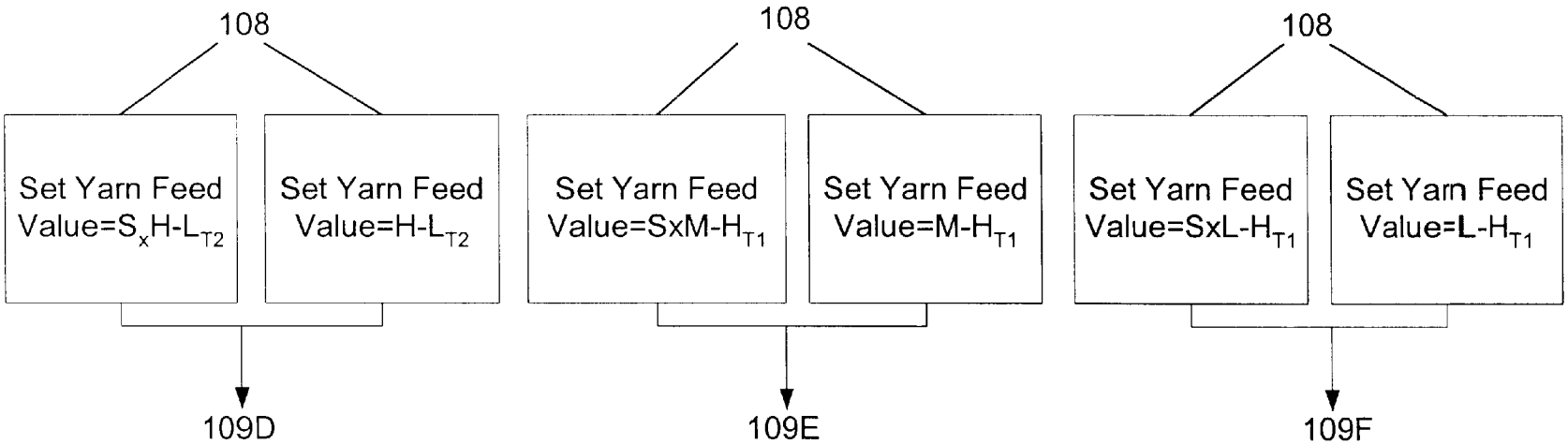
Figure 12S:
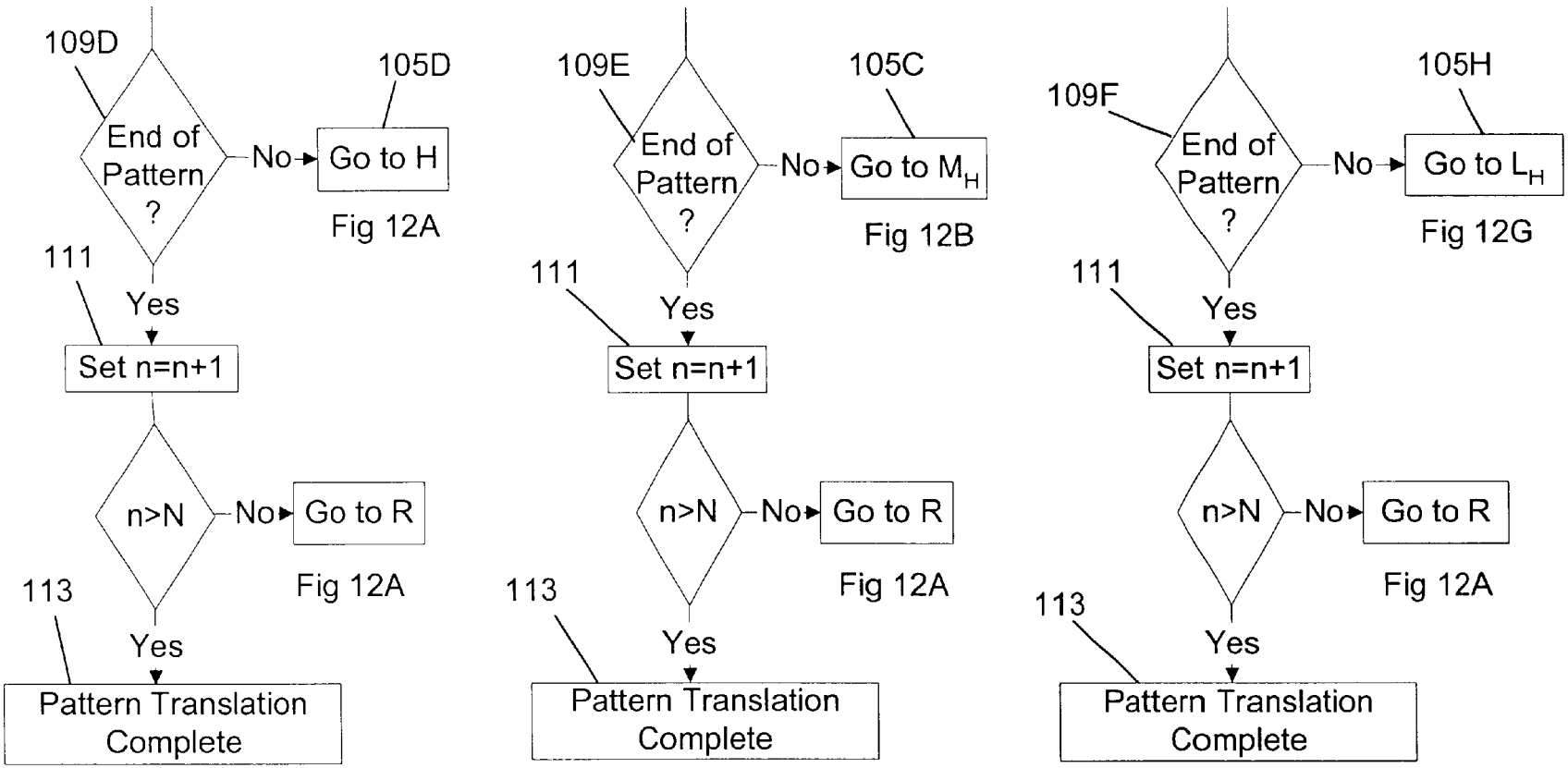
Figure 12T:
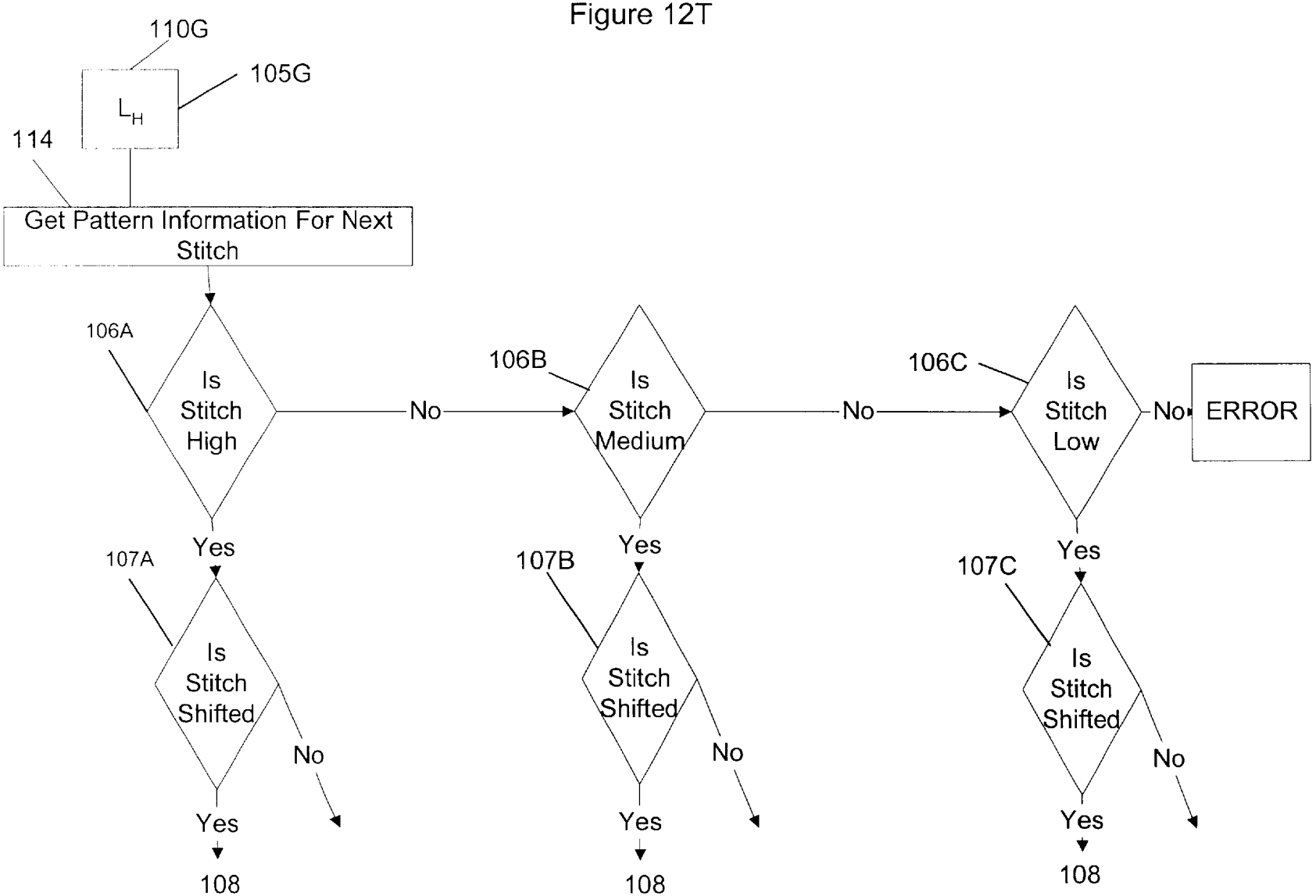
Figure 12U:
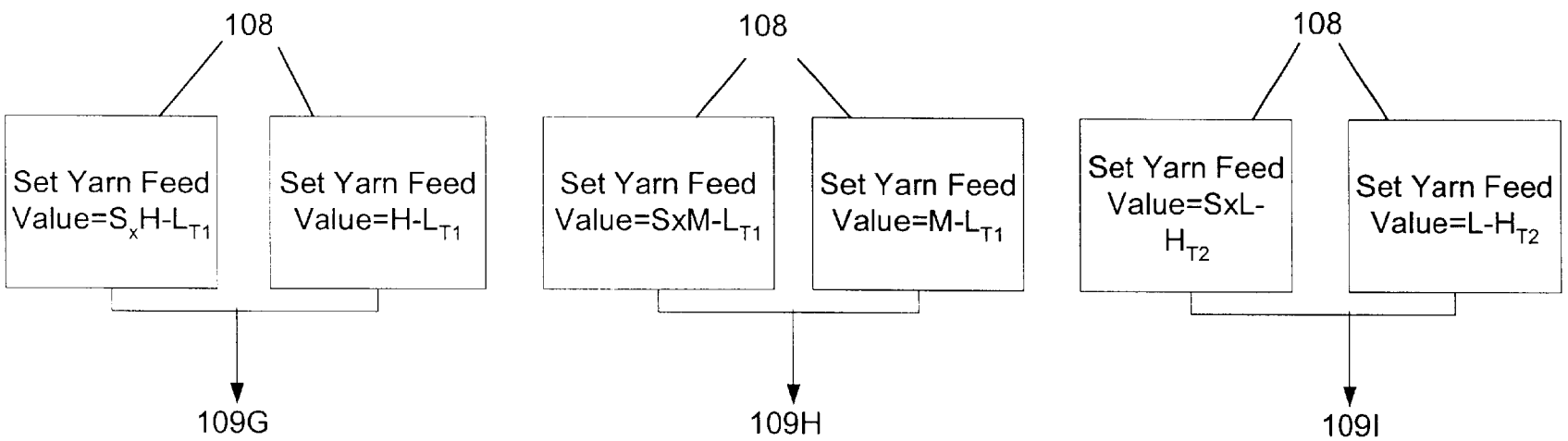
Figure 12V:
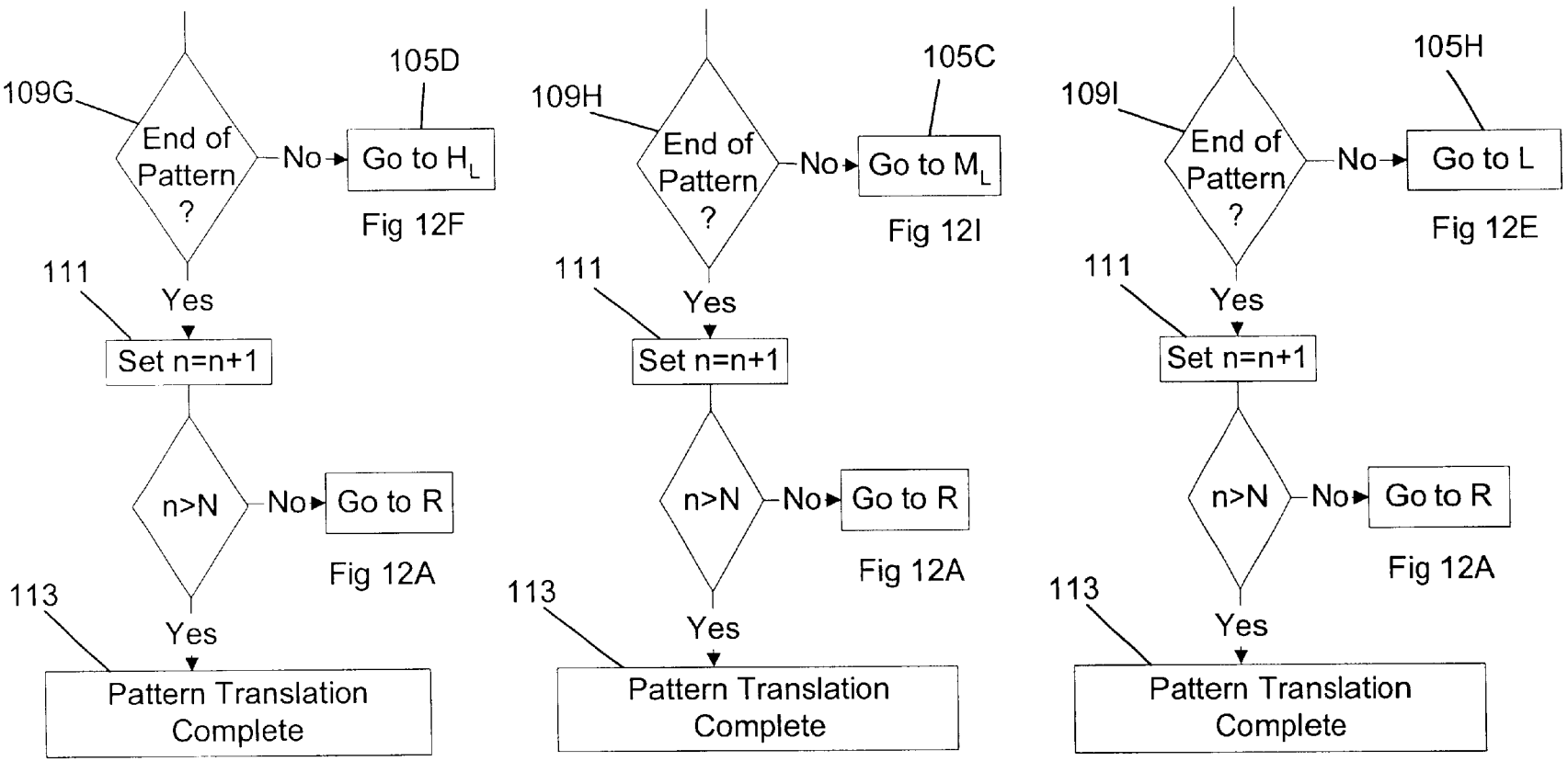
Figure 12W:
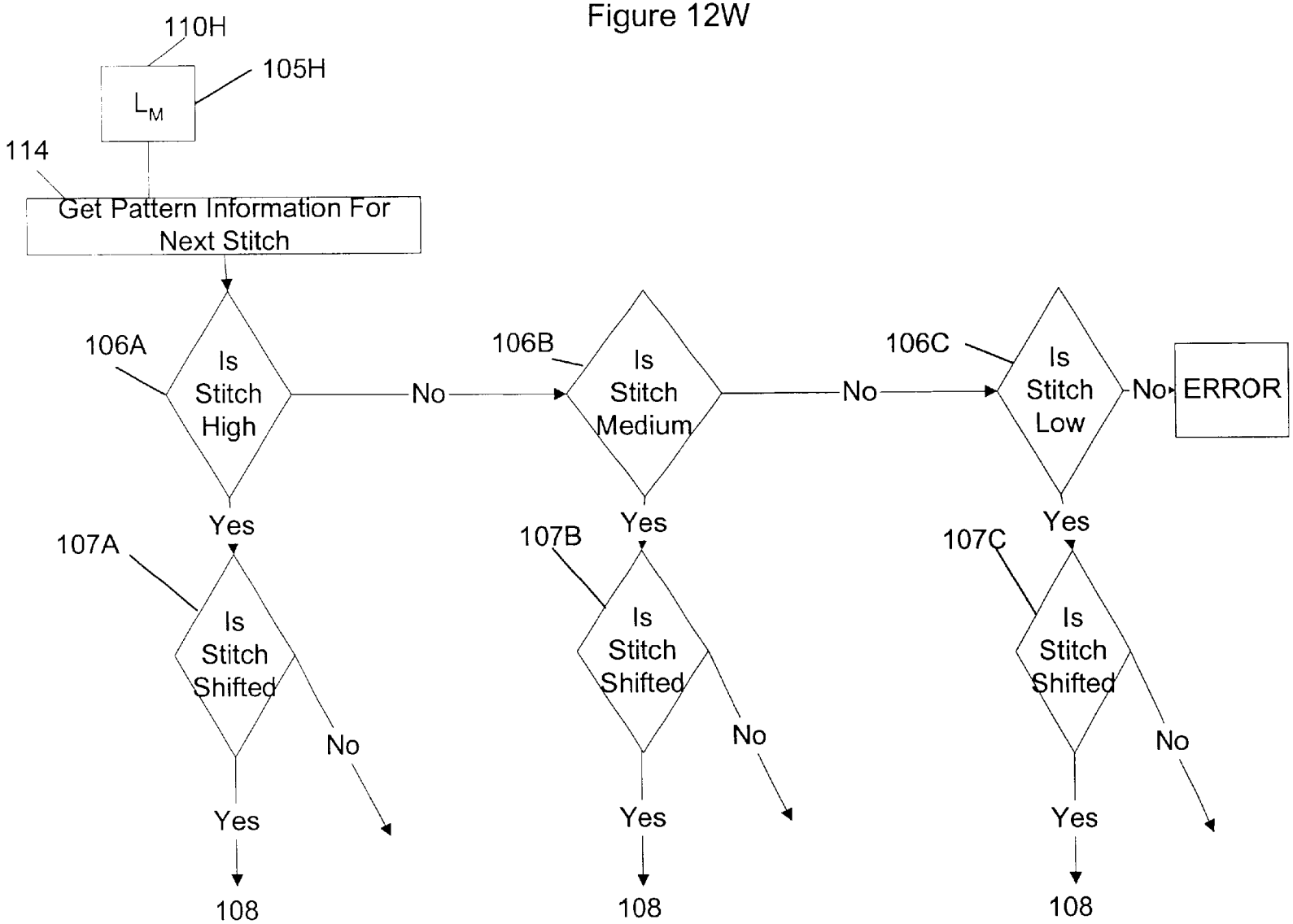
Figure 12X:
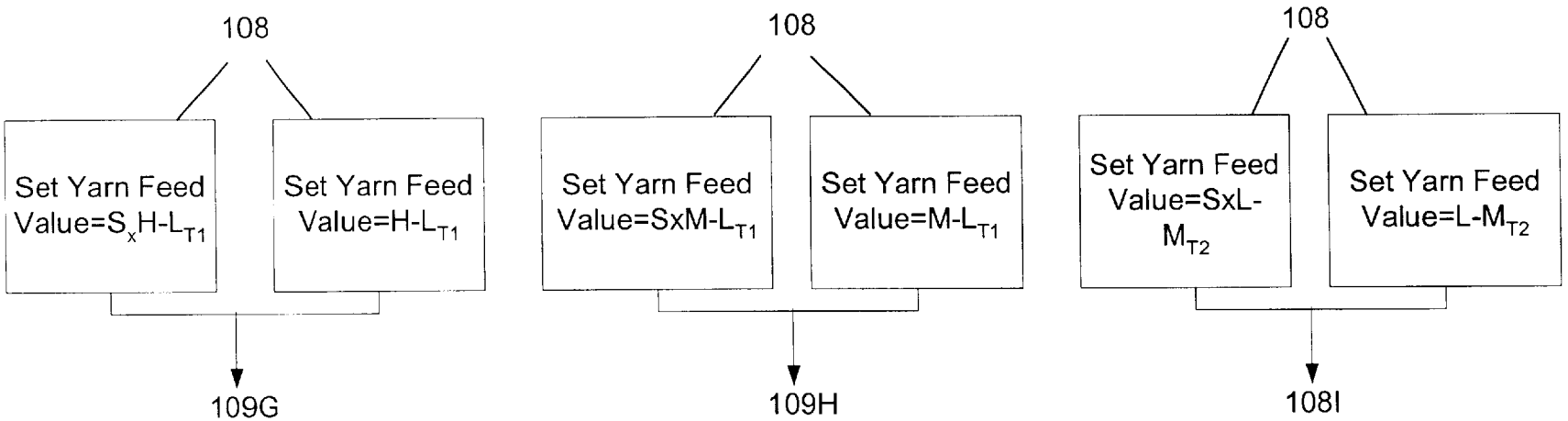
Figure 12Y:
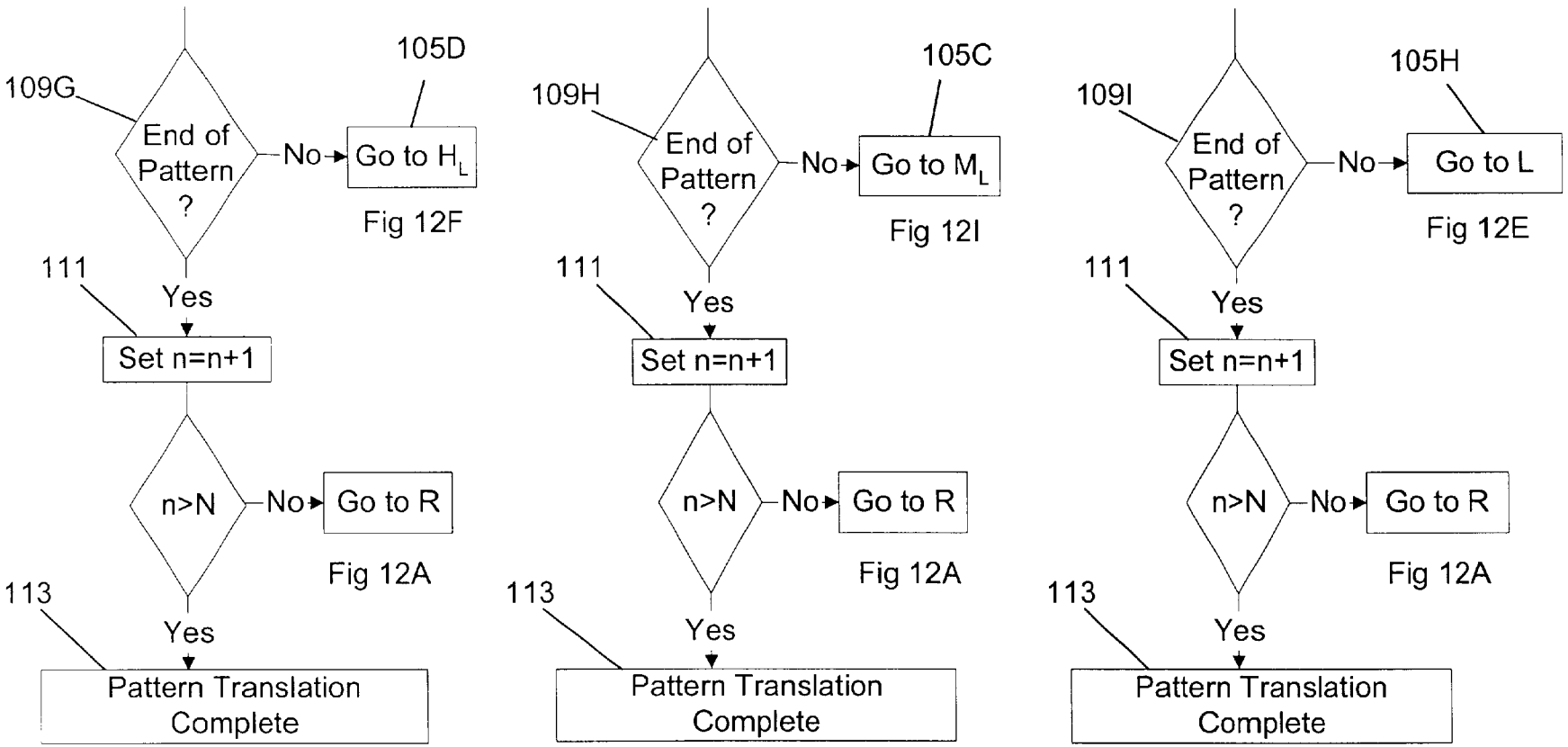
Figure 12Z:
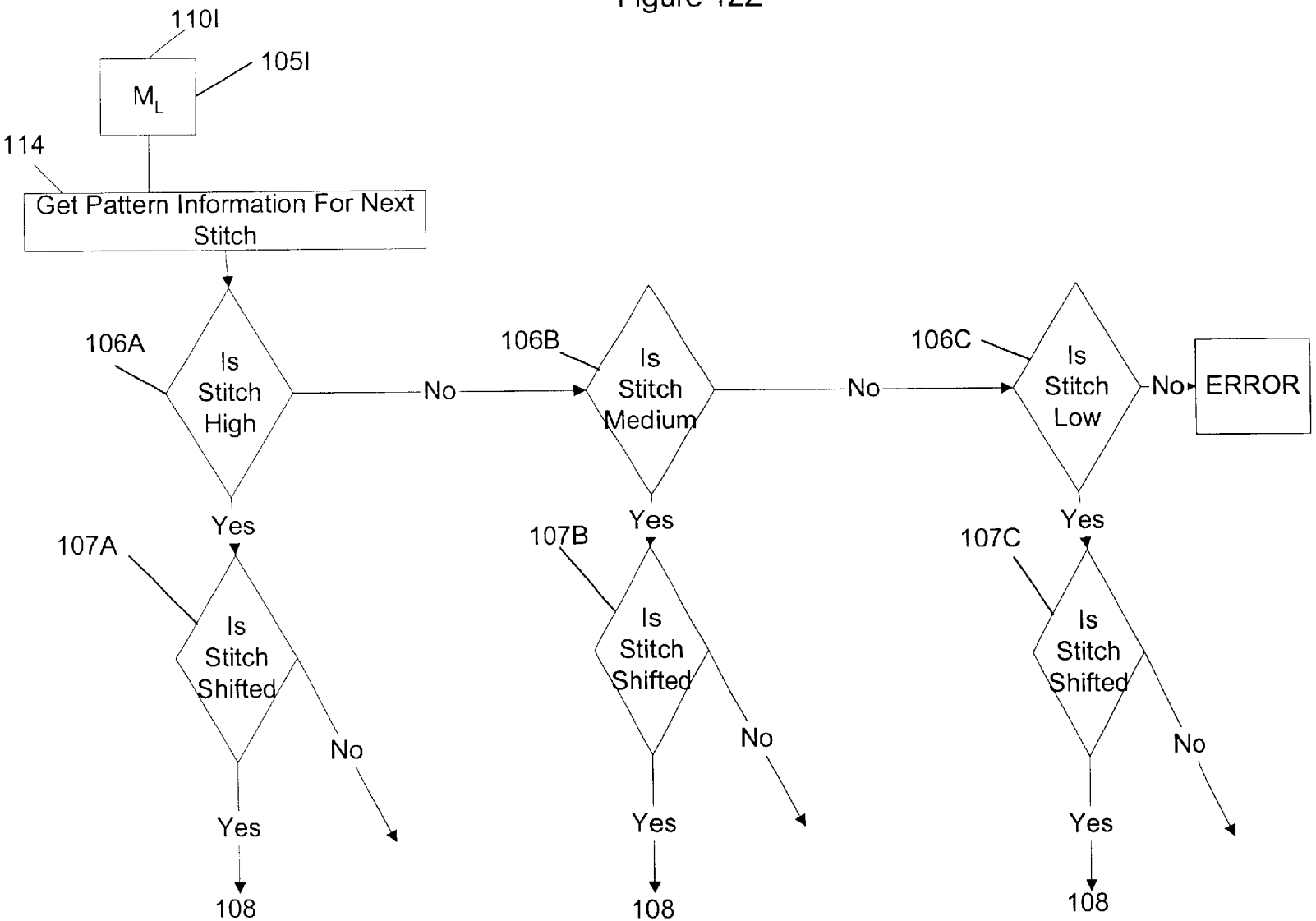
Figure 12A:
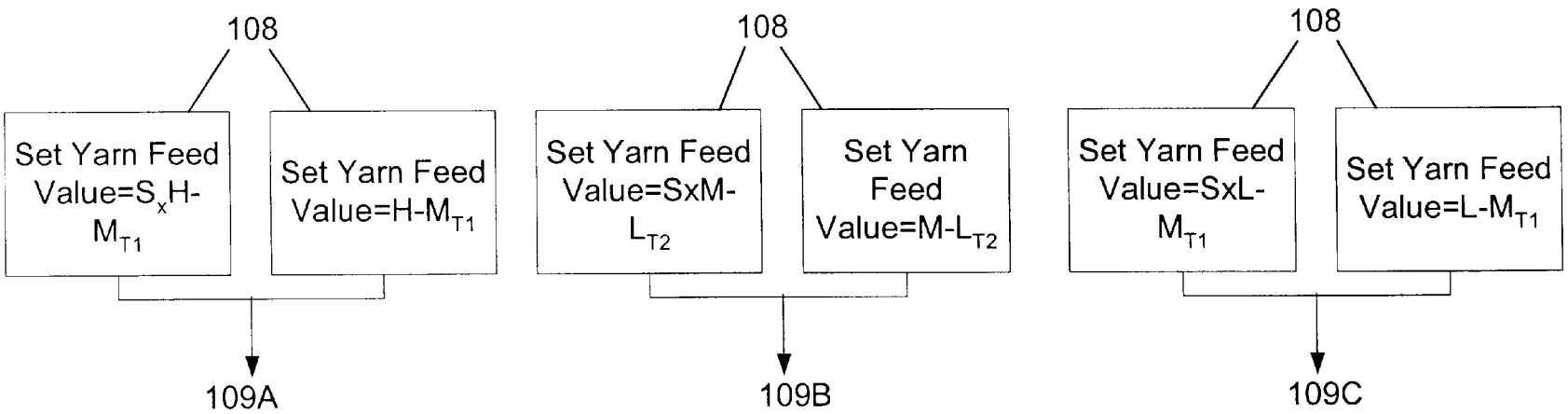
Figure 12B:
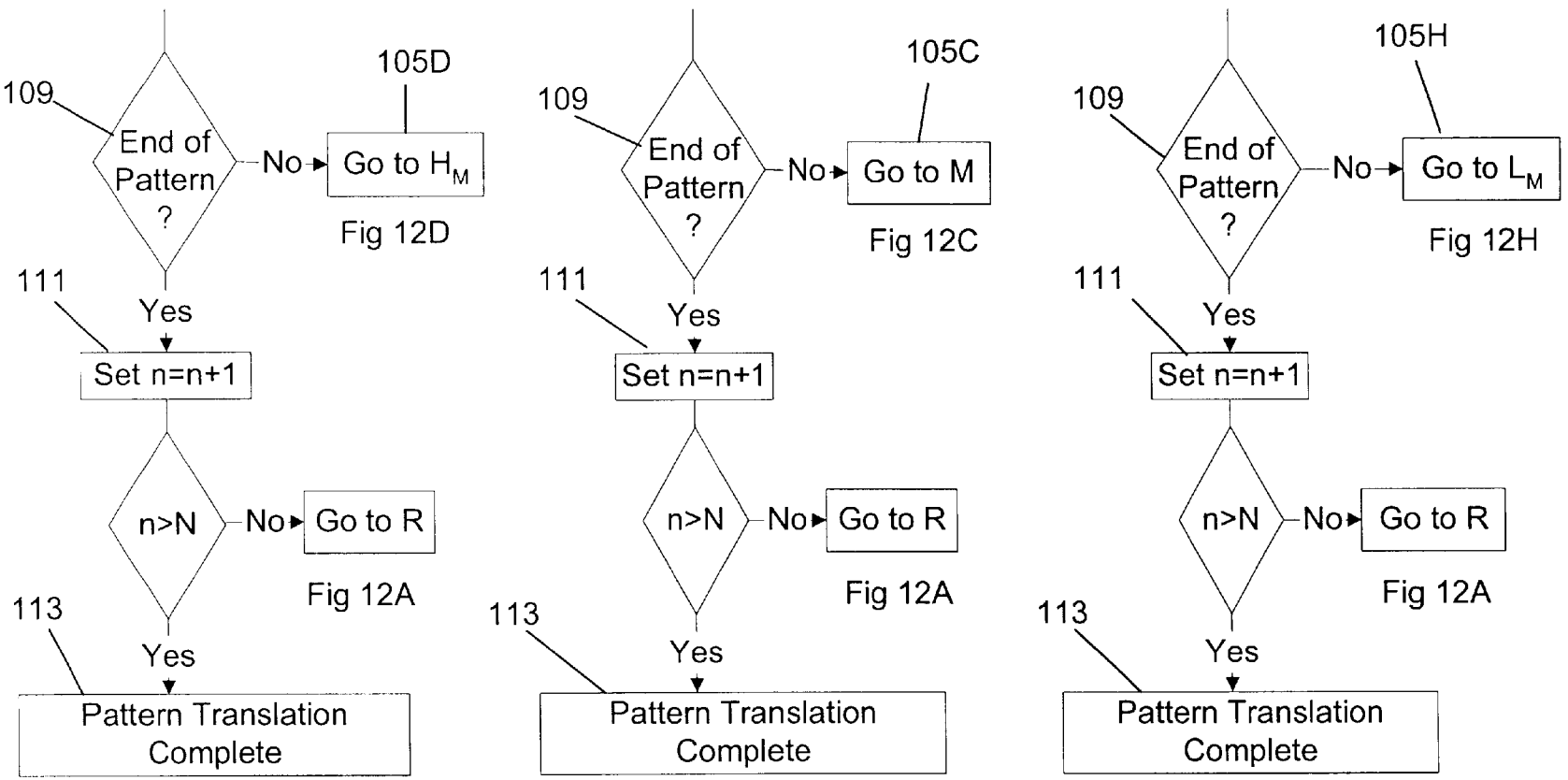

In order to properly anticipate how the beginning of the pattern must be tufted, particularly after each pattern repeat, the last two stitches of the pattern in a pattern width position are read into memory of the computer in step 103. In step 104, the last two stitches are compared to determine their heights. The decision boxes shown in steps 104A through 104I are designed for the situation where pattern heights for each stitch must be selected from high, medium, and low. In the event that additional finished pile heights are used, a more complex decision tree analysis must be utilized. Depending upon the previous two stitches, the first stitch in the pattern is processed in the appropriate decision tree 110A through 110I. For instance, if the last two stitches of the pattern are both high, decision tree 110A is utilized. In step 114, the pattern height information for the next stitch is obtained. In the next step 106, it is determined whether this next stitch is high, medium, or low in height and the appropriate sub-tree (106A, 106B, 106C) is utilized. In the sub-tree, the first query is to determine whether the stitch is shifted 107 and if so, shifted yarn feed values are applied in step 108. Otherwise, unshifted values are applied. Then the processor determines whether it is at the end of the pattern in step 109 and if not, step 105 directs processing to proceed at the appropriate decision tree 110. If it is the end of the pattern, step 111 increments the pattern width position counter and the process is repeated for the next pattern width position. This begins with reading in the last two stitches of the pattern for the particular width position in step 103 for each succeeding pattern width position. When the final pattern width position has been completely processed, step 113 shows that the pattern translation into yarn feed variables is complete. At this time, numeric values may be inserted for the various stitch designations. In the example of FIGS. 12A–12Z, 12AA, and 12BB with shifting of up to two steps, and three finished yarn pile heights, some 45 yarn feed values must be input.

For a typical pattern, approximate yarn feed values would initially be utilized and a short sample of carpet tufted. The resulting carpet would be examined and any necessary modifications to the stitch heights to produce the desired finish would be made. Such variations are required because of varying characteristics of different yarns and particularly yarn elasticity.

Figure 13A:
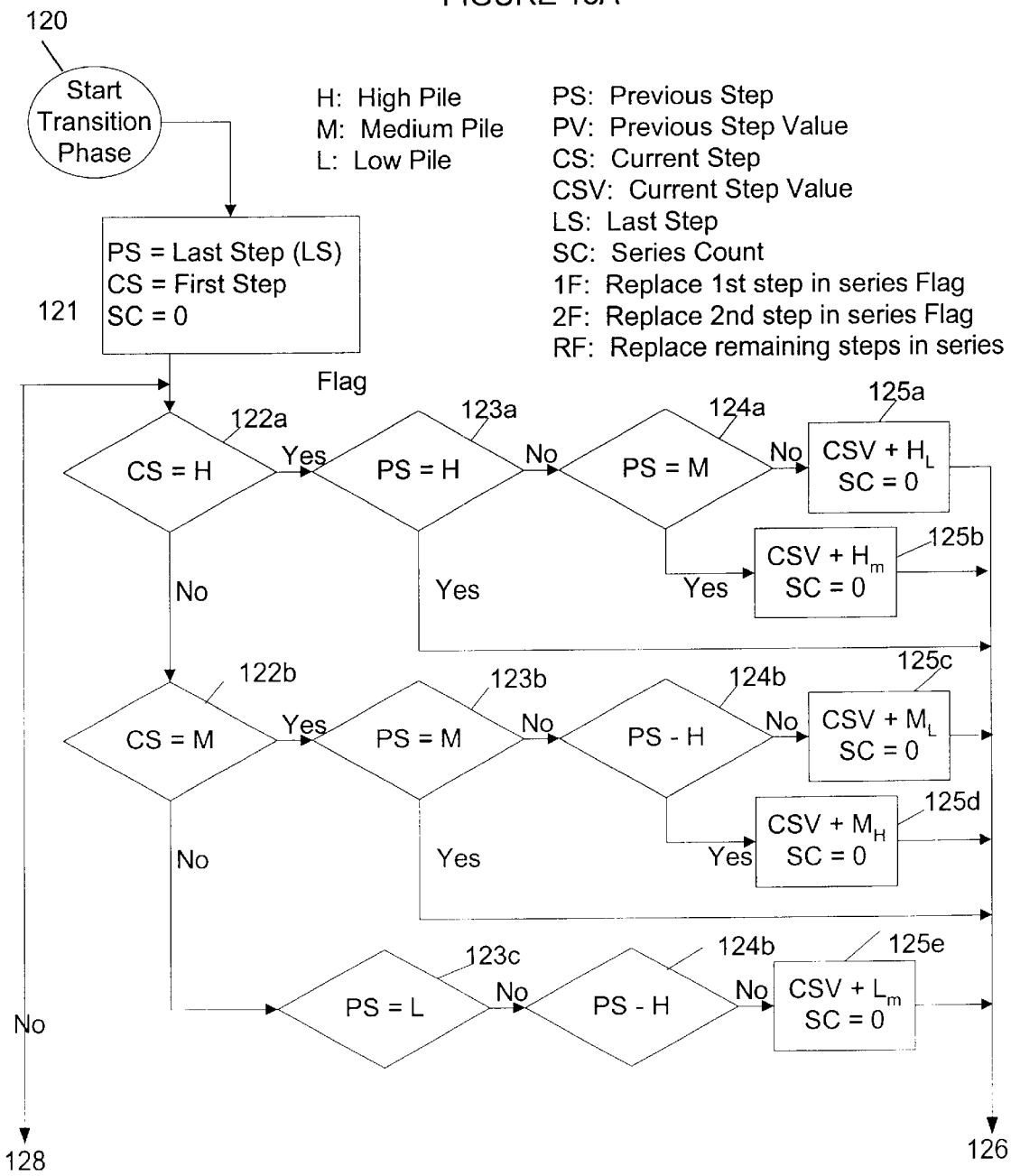
FIGS. 13A and 13B constitute a simplified flow chart for determining yarn feed values based upon the previous two stitches without regard to shifting.
Figure 13B:
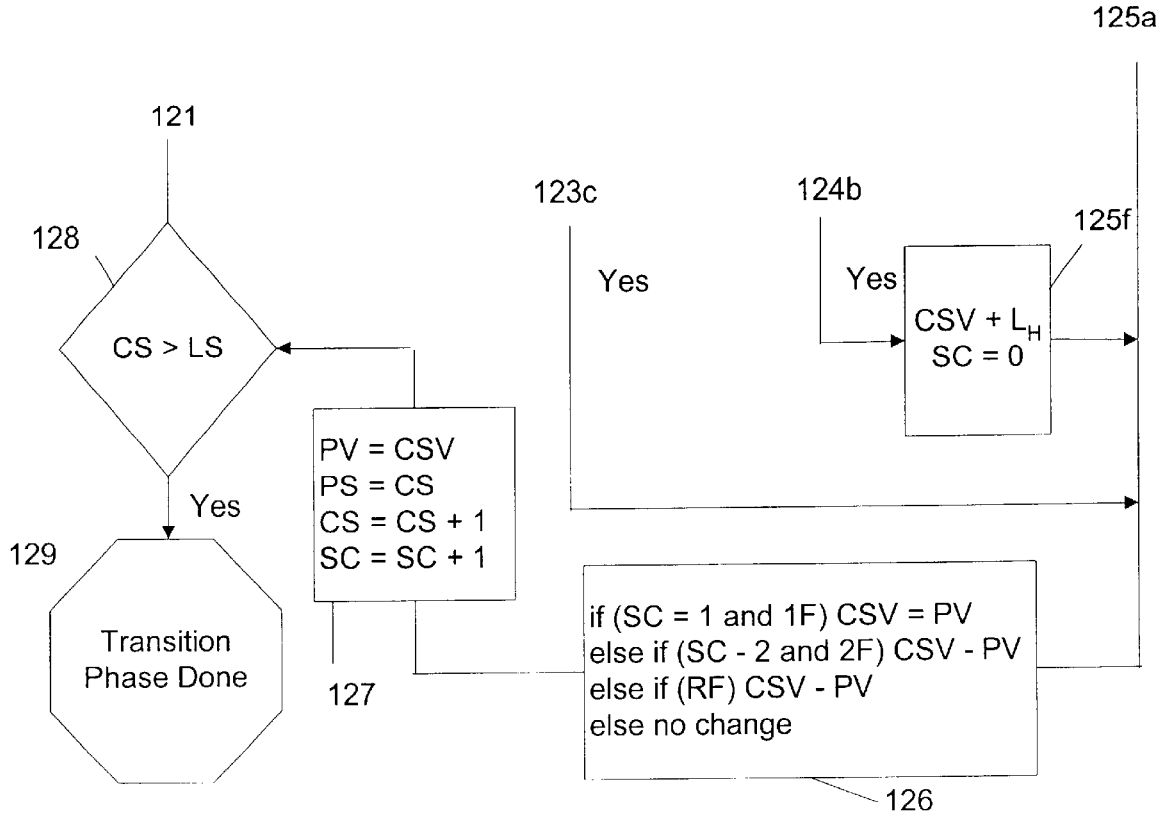

Alternative methods of developing yarn feed values may be implemented more simply in special cases. FIGS. 13A and 13B illustrate a flow chart for assigning yarn feed values when there are three pile heights (High, Medium and Low) and no shifting of the needle bar. The process starts at box 120 and values are initialized 121. The value of the current stitch or step is determined 122 and the value of the previous stitch or step is determined 123, 124. Based upon the values of the current and previous stitches, a Current Step Value is assigned 125.

In step 127, counters and prior stitch values are updated, and a check is performed to determine whether the last stitch has been reached 128. If there are more stitches, the determination of the new current stitch value 122 begins. If completed 129, the computed yarn feed values are substituted into the carpet pattern.

Figure 14A:
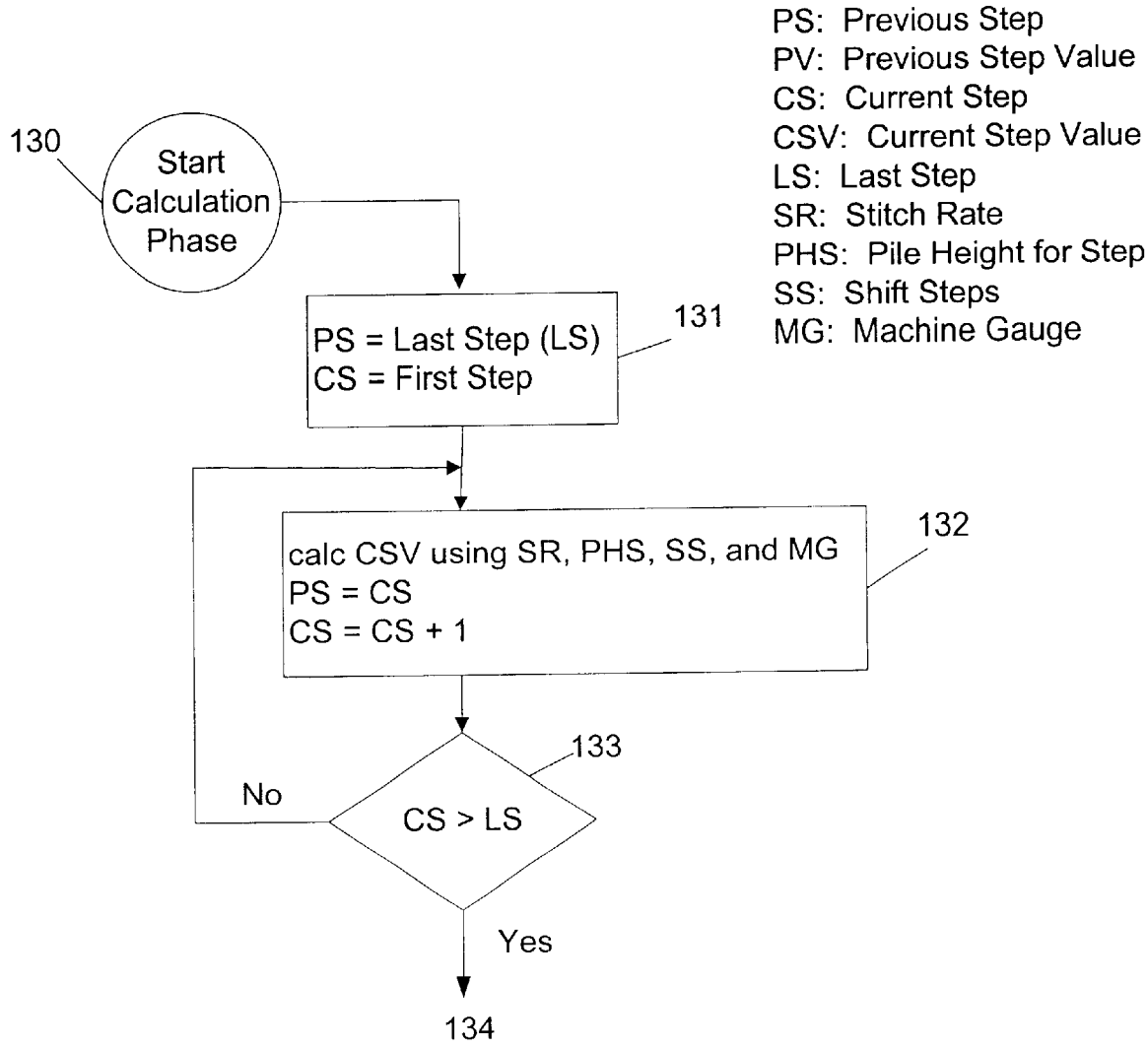
FIGS. 14A and 14B constitute a flow chart illustrating a method of approximating an appropriate yarn feed value for a given stitch.
Figure 14B:
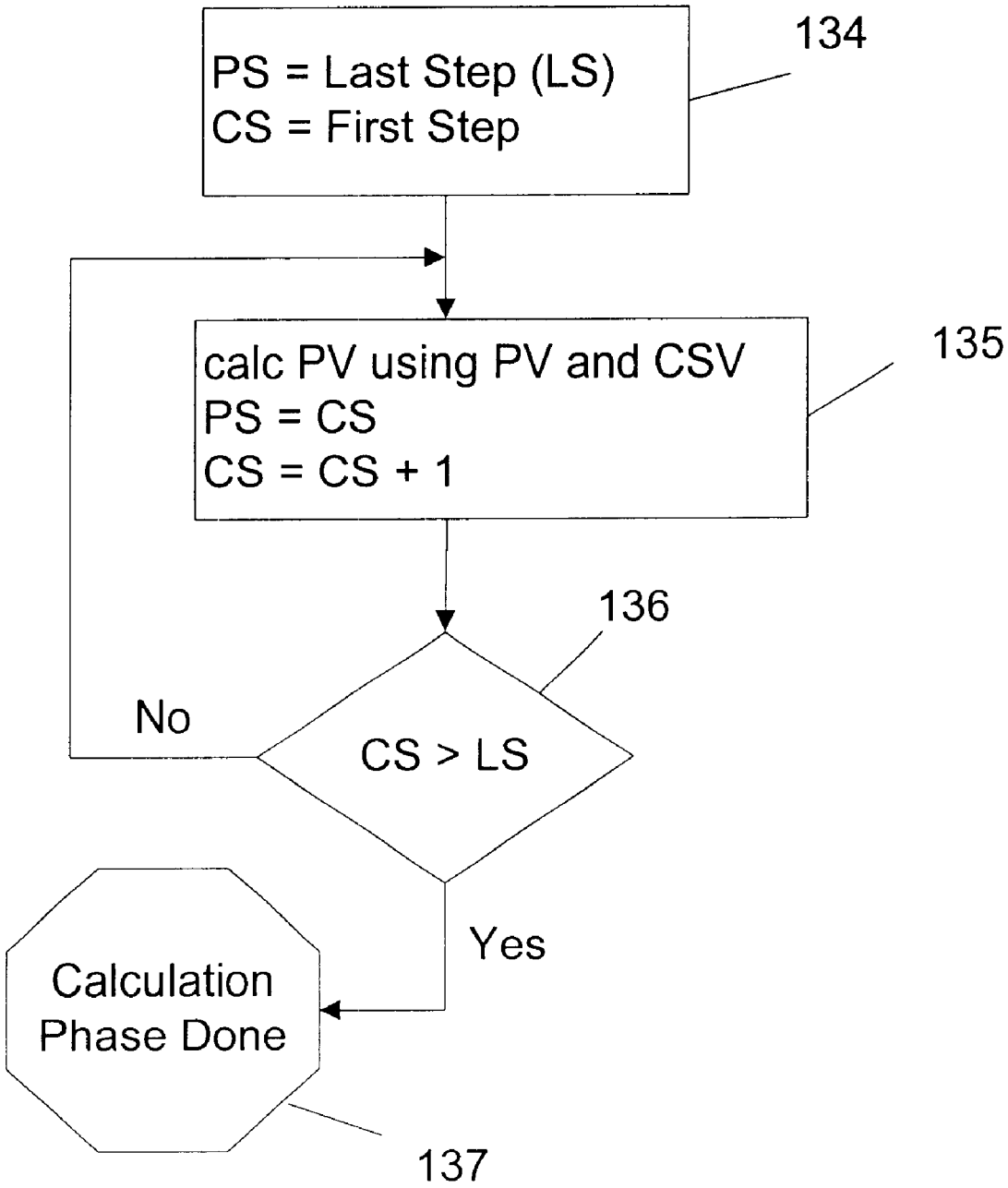

FIGS. 14A and 14B illustrate a method of approximating yarn feed values for a yarn pattern with many yarn feed variations. In this method, the yarn feed value calculation begins 130 and the values for the current step and previous step are initialized 131. The actual estimated amount of yarn to be provided to accomplish the desired current step or stitch is then calculated based upon the stitch rate (stitches per inch) , the intended pile height of the stitch, the number of positions the needle bar is shifted during the step or stitch, and the gauge of the needle bars 132. The values for the previous stitch and current stitch are updated and the process is repeated until the last stitch is processed 133. In this fashion each stitch is assigned an actual yarn feed value. However, it is desirable to feed yarn slightly in advance of the tufting machine's downstroke which pulls on the yarns and drives those yarns through the backing fabric.

Two methods have been devised to address this concern. The first is simply to utilize an encoder to report the position of the needles, or the main drive shaft of the tufting machine, and program the master controller 61 of the tufting machine to signal yarn feed motors to feed the yarn required for the current stitch slightly in advance of the downstroke. This method is satisfactory for independently controlled yarn feed drives. However, to accommodate less sophisticated yarn feeds, it is sometimes desirable to provide yarn feed value that can be fed in synchronization with the tufting machine stitches. In step 135 it is shown that by blending the yarn feed values for the previous stitch and the current stitch a more appropriate amount of yarn can be fed to the needles. Thus by the time the previous stitch is tufted, the yarn for that stitch as calculated in step 132 has been fed and a portion of the yarn required for the current stitch has also been fed to the needles. This forward averaging of the yarn feed values in step 135 is repeated through the stitches and when the last stitch is reached 136, the calculation of values is complete 137 and may be utilized for the pattern.

The software also can preferably automatically compute the length of yarn required for a particular design by summing the length of the stitches for a given length of the design, and will translate that information to carpet weight depending upon the deniers of the yarns selected. It will be readily apparent that without the advantages provided by the related software, it would be very time consuming to take advantage of the power and advantages of the present individualized servo motor controlled yarn feed attachment.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

We claim:

1. In a multiple needle tufting machine adapted to feed a backing fabric from front to rear through the machine having a plurality of spaced needles aligned transversely of the machine for reciprocable movement through the backing fabric by operation of a rotary main drive shaft, a scroll-type yarn feed mechanism comprising:

(a) a plurality of yarn feed mounting plates extending generally in the direction of the yarn feed and having opposed planar sides perpendicular thereto;

(b) at least two independent yarn feed rolls on each of said yarn feed mounting plates;

(c) a separate servo motor associated with each of said independent yarn feed rolls;

(d) at least one controller electronically connected to each said separate servo motor.

2. The yarn feed mechanism of claim 1 wherein each of said at least two independent yarn feed rolls is associated with a second yarn feed roll to constitute a pair of yarn feed rolls.

3. The yarn feed mechanism of claim 1 wherein each of said at least two independent yarn feed rolls can be rotated at any one of at least sixteen speeds by said associated separate servo motor.

4. The yarn feed mechanism of claim 2 wherein said pairs of yarn feed rolls have a mass of less than about two pounds.

5. The yarn feed mechanism of claim 1 wherein a separate set of yarn feed tubes is associated with each of said at least two independent yarn feed rolls.

6. The yarn feed mechanism of claim 1 wherein a drive sprocket of the separate servo motor is in mechanical communication with its associated independent yarn feed roll on said yarn feed mounting plate such that the rotations of the drive sprocket correspond to the rotations of the yarn feed roll in the range of ratios from between about 8:1 to about 24:1.

7. The yarn feed mechanism of claim 6 wherein the yarn feed roll has a gear toothed section for mechanical communication.

8. The yarn feed mechanism of claim 1 wherein the separate servo motor associated with each of said independent yarn feed rolls provides positional control information to the electronically connected controller.

9. The yarn feed mechanism of claim 1 wherein at least one of said at least two independent yarn feed rolls is mounted on each opposed planar side of the yarn feed mounting plate.

* * * * *